US007156366B2

(12) United States Patent
Sakuragi et al.

(10) Patent No.: US 7,156,366 B2
(45) Date of Patent: Jan. 2, 2007

(54) ELECTROMAGNETICALLY DRIVEN VALVE DEVICE

(75) Inventors: Takeshi Sakuragi, Toyota (JP); Takashi Izuo, Toyota (JP); Masahiko Asano, Toyota (JP); Kiyoharu Nakamura, Seto (JP); Yutaka Sugie, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 31 days.

(21) Appl. No.: 10/684,518

(22) Filed: Oct. 15, 2003

(65) Prior Publication Data

US 2004/0108482 A1 Jun. 10, 2004

(30) Foreign Application Priority Data

Oct. 25, 2002 (JP) ..... 2002-311667

(51) Int. Cl.
*F01L 9/04* (2006.01)
*F16K 31/02* (2006.01)

(52) U.S. Cl. ..... 251/129.1; 123/90.11

(58) Field of Classification Search ..... 251/129.09, 251/129.1; 123/90.11
See application file for complete search history.

(56) References Cited

U.S. PATENT DOCUMENTS

| | | | | |
|---|---|---|---|---|
| 3,842,860 | A * | 10/1974 | Stampfli | 137/596.17 |
| 4,742,988 | A | 5/1988 | Haneda et al. | |
| 5,351,934 | A * | 10/1994 | Jensen et al. | 251/65 |
| 5,799,630 | A | 9/1998 | Moriya et al. | |
| 6,157,277 | A | 12/2000 | Bulgatz et al. | |
| 6,176,208 | B1 | 1/2001 | Tsuzuki et al. | |
| 6,182,942 | B1 * | 2/2001 | Kadlicko | 251/129.1 |
| 6,237,550 | B1 * | 5/2001 | Hatano et al. | 123/90.11 |
| 6,830,233 | B1 * | 12/2004 | Katsumata et al. | 251/129.1 |

FOREIGN PATENT DOCUMENTS

| | | |
|---|---|---|
| DE | 32 00 023 | 7/1983 |
| DE | 689 02 346 | 12/1992 |
| DE | 43 43 325 | 6/1995 |
| DE | 195 18 519 | 11/1996 |
| DE | 297 12 502 | 10/1997 |
| DE | 198 42 334 | 12/1999 |
| DE | 10053465 | 5/2001 |
| DE | 100 31 233 A1 | 3/2002 |
| DE | 698 09 177 | 7/2003 |
| EP | 0 795 881 | 9/1997 |
| EP | 0 796 981 | 9/1997 |
| EP | 0 921 536 | 6/1999 |
| EP | 0 923 089 | 6/1999 |
| EP | 0 923 090 | 6/1999 |
| EP | 1 002 938 A2 | 5/2000 |
| JP | 2001-126919 A | 5/2001 |
| JP | 2001-126922 A | 5/2001 |
| WO | WO 95/00787 | 1/1995 |
| WO | WO 97/30104 | 11/1995 |
| WO | WO 97/17561 | 5/1997 |

* cited by examiner

*Primary Examiner*—J. Csaimer Jacyna
(74) *Attorney, Agent, or Firm*—Kenyon & Kenyon LLP

(57) ABSTRACT

An electromagnetically driven valve device is formed by attaching a lower core assy, an armature, an upper core assy, and an upper case in that order from bottom, to a cylinder head of an engine. Each of the lower core assy and the upper core assy is unitarily formed so as to have a predetermined shape by resin-molding a core and a coil that form an electromagnet as well as an armature bearing, etc. The lower core assy is fastened together with the upper core assy to the cylinder head, and is thus attached to the mounting surface.

20 Claims, 13 Drawing Sheets

ELECTROMAGNETICALLY DRIVEN VALVE DEVICE

INCORPORATION BY REFERENCE

The disclosure of Japanese Patent Application No. 2002-311667 filed on Oct. 25, 2002, including the specification, drawings and abstract, is incorporated herein by reference in its entirety.

BACKGROUND OF THE INVENTION

1. Field of the Invention

The invention relates to an electromagnetically driven valve device provided as an engine valve of an internal combustion engine for opening and closing a valve element of the valve device by electromagnetic force.

2. Description of the Related Art

An electromagnetically driven valve device of the aforementioned type is described in, for example, Japanese Patent Application Laid-Open Publication No. 2001-126922. This valve device includes an armature that reciprocates together with an engine valve of an internal combustion engine, and electromagnets disposed in the directions of the ends of displacement of the armature. The armature is driven by the electromagnetic attraction force generated between the armature and the electromagnets, thereby opening and closing the engine valve.

In this type of electromagnetically driven valve device, the armature and the electromagnets are normally positioned by retaining them to a housing, as described in Japanese Patent Application Laid-Open Publication No. 2001-126919. The armature is held so as to be slidable in a space between the two electromagnets, and is driven in accordance with the pattern of electrification of the coils of the electromagnets.

As for the housing, an iron or the like is used as a material because of the ease of working at the time of fixation of the electromagnets by welding or the like. However, if such a metal as iron or the like that allows welding is used, a weight increase of the entire device may become a problem. Therefore, if a weight reduction of the device is demanded, a light-weight metal, such as aluminum or the like, is often used as a material of the housing. However, the use of a light-weight metal, such as aluminum or the like, makes it difficult to attach electromagnets to the housing by welding or the like, while achieving a weight reduction of the device. As a result, the electromagnets are indirectly secured to the light-weight metal housing through the use of screws, bolts or the like, thus degrading the ease of assembly.

(For Us)

SUMMARY OF THE INVENTION

It is an object of the invention to provide an electromagnetically driven valve device that is easy to assemble while having a light-weight and simple construction.

An electromagnetically driven valve device according to a first aspect of the invention including a pair of electromagnets facing each other, and an armature that reciprocates by being attracted to the pair of electromagnets so as to open and close a valve element. In this device, at least a first electromagnet of the pair of electromagnets is integrated with a retainer member that retains the first electromagnet so as to form an assembly, and the pair of electromagnets and the armature are mounted by co-fastening the assembly together with a second electromagnet of the pair of electromagnets or another assembly to a mounting surface provided for the electromagnetically driven valve device.

According to the first aspect, the assembly incorporating one electromagnet of the pair of electromagnets is fastened together with the other electromagnet or the assembly incorporating the other electromagnet to the mounting surface provided for the electromagnetically driven valve device. In this manner, the electromagnets and the armature are mounted. Therefore, it becomes possible to retain the electromagnets and the armature at predetermined positions without attaching a housing for retaining the electromagnets and the armature. Hence, the assembly and mounting at the time of forming the electromagnetically driven valve device is simplified. Furthermore, if a light-weight material is used for the retainer member, the device can be reduced in weight.

In the first aspect of the invention, the retainer member may be molded together with the electromagnet so as to have a predetermined shape and unitarily retain the electromagnet. Thus, the molding process facilitates consolidation of the assembly incorporating the electromagnet. If a high-elasticity resin is used as a material of the molding, the resin absorbs energy transmitted due to reciprocating movements of the armature, thereby reducing the operation noise of the electromagnetically driven valve device.

In the first aspect of the invention, the assembly fastened together with the other electromagnet or the other assembly may have an urging member that is provided on a face in the assembly which is remote from the mounting surface and that urges the armature in a direction of the mounting surface, and the assembly may also be provided with a casing that houses the urging member. The casing is formed by pressing. Thus, the assembly fastened together with the other electromagnet or the other assembly has, at a surface remote from the mounting surface, the casing that houses the urging member and that is formed by pressing. Therefore, in the electromagnetically driven valve device provided with the urging member as well as the electromagnets, the casing for housing the urging member can be easily obtained without a need for the cutting or grinding process or the like.

In the above aspect of the invention, the casing may be formed using a material containing a magnetic substance. Thus, the casing can be provided with a magnetic shield effect. Therefore, if a sensor or the like utilizing magnetism, as for example, is disposed within the casing, undesired magnetic interference with an external device or the like can be avoided without a need to provide a separate member as a magnetic shield. Therefore, the casing can be simplified in construction, and can be reduced in weight.

In the above aspect of the invention, the casing may have such a shape as to form a gap that allows passage of a fluid between the casing and the assembly that is fastened together with the second electromagnet or the another assembly. Thus, if a fluid is supplied around the co-fastened assemblies, the fluid can be more smoothly supplied between the assemblies and the casing. Therefore, if a fluid for cooling the assemblies is supplied, the cooling efficiency can be improved.

In the above aspect of the invention, at least two armature-electromagnet sets each of which includes the pair of electromagnets and the armature movable in association with the pair of electromagnets may be disposed adjacent to each other, and at least two casings provided corresponding to the at least two armature-electromagnet sets may be formed in such a fashion that the at least two casings are connected to each other. Thus, since the at least two casings are connected to each other, the rigidity increases.

In the first aspect of the invention, each electromagnet may have a planar shape having a relatively long dimension and a relatively short dimension. Two pairs of electromagnets may be provided, and the assemblies may be formed with respect to each pair of electromagnets, and both assemblies may be provided so as to attract the armature in the same direction. The two electromagnets integrated may be disposed so that a relatively long side of one of the two electromagnets and a relatively long side of another one of the two electromagnets are adjacent to each other, and so that a predetermined opening angle is formed between lengthwise axes of the two electromagnets. Thus, two pairs of electromagnets each having a planar shape (i.e., a shape viewed on a plane) that has a long dimension and a short dimension, are disposed in the following manner. That is, two electromagnets for attracting the armature in one direction and two electromagnets for attracting the armature in another direction are separately disposed so that longer sides of the two electromagnets are adjacent to each other and so that a predetermined opening angle is formed between the lengthwise axes of the electromagnets. Therefore, an increased space is secured at the opening portion. Hence, if another member, such as an ignition plug or the like, is disposed, the member can be disposed with an increased degree of freedom.

In the first aspect of the invention, the electromagnetically driven valve device may further include a co-fastening member that co-fastens the assembly and the second electromagnet or the another assembly to the mounting surface. In this device, the co-fastening member is disposed in a through-hole formed in the assembly so as to fix the assembly to the mounting surface. The through-hole allows a fluid to be supplied to the assembly. Thus, the co-fastening member for the co-fastening operation, such as a bolt or the like, is disposed in the through-hole. Via the through-hole, a fluid can be supplied to the co-fastened assemblies. Therefore, if a fluid for cooling or the like is supplied to the assemblies, the supply of the fluid to the assemblies from a fluid source can be accomplished via a simple construction without a need to employ a tube or piping.

In the above aspect of the invention, the electromagnetically driven valve device may further include a supporting portion that is provided in the assembly co-fastened with the second electromagnet or the another assembly and that supports the armature for the reciprocating movements, and a fluid passageway in which the fluid passes. The fluid passageway includes a first recess portion provided in a surface of the assembly which is opposite from a surface that is attached to the mounting surface. More specifically, the first recess portion is provided in a portion of the surface that includes a portion near the supporting portion and that is adjacent to the electromagnet incorporated in the assembly. Thus, the assembly co-fastened with the second electromagnet or the other assembly has the supporting portion for supporting the armature for reciprocating movements. The surface of the assembly which is opposite from the surface attached to the mounting surface is provided with the recess formed in a portion that includes a portion near the supporting portion and that is adjacent to the electromagnet incorporated in the assembly. Therefore, the lubrication and cooling of the supporting portion and the cooling of the assemblies via fluid can be improved in efficiency. If the area of the recess is increased, the efficiency in the cooling of the assemblies can be further improved. Furthermore, since the supporting portion is integrated with the assembly, it becomes unnecessary to separately provide bearings for the armature. Therefore, the electromagnetically driven valve device can be reduced in size.

In the above aspect of the invention, the assembly may be disposed so that a surface of the assembly which is opposite from the surface attached to the mounting surface is located upward. Thus, the electromagnetically driven valve device is disposed so that the opening of the recess portion faces upward. Therefore, the fluid is held in the recess portion even after the electromagnetically driven valve device stops operating. Hence, the initial supply of the fluid at the time of startup of the device is more smoothly performed.

In the above aspect of the invention, a spacer for adjusting a mounting height of the assembly fastened together with the second electromagnet or the another assembly, with respect to the mounting surface, may be disposed near the through-hole in which the co-fastening member is disposed. Thus, since the spacer is disposed near the through-hole, the mounting height with respect to the mounting surface can be more precisely adjusted even if the co-fastened assemblies are formed using an elastic material or the like.

In the first aspect of the invention, the electromagnetically driven valve device may further include a second recess portion that forms the mounting surface and that substantially conforms to a shape of the second electromagnet or the another assembly fastened together with the assembly. The second recess portion provides a predetermined clearance between a side wall of the second recess portion and the second electromagnet or the another assembly fastened together with the assembly. Thus, the second recess portion is provided corresponding to the shape of the second magnet or the assembly incorporating the second magnet fastened together with the first assembly so that a predetermined clearance is formed between the side wall of the recess portion and the second magnet or the assembly incorporating the second magnet. Therefore, if a fluid for cooling or the like is supplied around the second electromagnet or the assembly incorporating the second magnet, an increased amount of the fluid is supplied, thereby increasing the effect of cooling or the like.

In the first aspect of the invention, each electromagnet of the pair of electromagnets may be integrated with the retainer member that retains the electromagnet so as to form an assembly, and a first assembly of the two assemblies is fastened together with a second assembly of the two assemblies to the mounting surface for the electromagnetically driven valve device so as to mount the pair of electromagnets and the armature. A coil of each electromagnet may be embedded in a corresponding assembly of the two assemblies so that a connecting terminal of the coil is exposed on a surface of the corresponding assembly. Thus, the assembly incorporating one of the two electromagnets fastened together with the other electromagnet or the assembly incorporating the other electromagnet to the mounting surface provided for the electromagnetically driven valve device. In this manner, the electromagnets and the armature are mounted. The coils of the electromagnets are embedded in the assemblies so that the connecting terminals of the coils are exposed on the surfaces of the assemblies. Therefore, it is possible to make electrical connection to the coils from outside after attaching and mechanically fixing the assemblies to the mounting surface. Thus, this construction is favorable for the electric wiring layout operation.

In the above aspect of the invention, the connecting terminals of the coils exposed on the surfaces of the assemblies may be disposed in a predetermined positional relationship in a surface of the first assembly and a surface of the second assembly which face in one direction. Thus, since the connecting terminals of the coils exposed on the surfaces of the assemblies are disposed in a predetermined positional relationship in the surface of the first assembly and the surface of the second assembly which face in one direction, the efficiency in the wiring layout operation can be further improved. Furthermore, if a connector member for connecting to the connecting terminals disposed in a predetermined positional relationship in the surfaces of the assemblies facing in the same direction is prepared, the connection to the connecting terminals can be accomplished by one action.

In the above aspect of the invention, a guide member that guides attachment of a connector member for electrical connection of the exposed connecting terminals of the coils may be disposed on at least one of the surface of the first assembly and the surface of the second assembly which face in one direction. Thus, the attachment of the electrical connector member to the connecting terminals of the coils exposed on the surfaces of the assemblies facing in the same direction can be more properly performed due to the guidance by the guide member. Therefore, the danger of inadvertently breaking a connecting terminal at the time of attaching the connector member is reduced.

In the above aspect of the invention, the guide member may further include a fall-apart preventing mechanism that substantially prevents the guide member from falling apart. The fall-apart preventing mechanism is provided in an attachment portion that is engaged when the connector member is attached to the surface of the first assembly and the surface of the second assembly which face in one direction. Thus, the attachment portion of the guide member which is engaged when the connector member is attached to the surfaces of the assemblies facing in the same direction is provided with the fall-apart preventing mechanism. Therefore, the connection between the connecting terminals and the connector member can be more reliably maintained. The fall-apart preventing mechanism can be embodied, for example, by providing the attachment portion of the guide member attached to the connector member with a snap-fit structure, or by attaching the guide member and then deforming a head portion of the guide member via heat, ultrasonic wave or the like so as to stop the attachment portion attached to the connector member.

An electromagnetically driven valve device according to a second aspect of the invention including a pair of electromagnets facing each other, and an armature that reciprocates by being attracted to the pair of electromagnets so as to open and close a valve element. At least a first electromagnet of the pair of electromagnets is integrated with retention means for retaining the first electromagnet so as to form an assembly. The pair of electromagnets and the armature are mounted by co-fastening the assembly together with a second electromagnet of the pair of electromagnets or another assembly to a mounting surface provided for the electromagnetically driven valve device. Thus, the assembly incorporating one electromagnet of the pair of electromagnets is fastened together with the other electromagnet or the assembly incorporating the other electromagnet to the mounting surface for the electromagnetically driven valve device. In this manner, the electromagnets and the armature are mounted. Therefore, it becomes possible to retain the electromagnets and the armature at predetermined positions without attaching a housing for retaining the electromagnets and the armature. Hence, the assembly and mounting at the time of forming the electromagnetically driven valve device is simplified. Furthermore, if a light-weight material is used for the retention means, the device can be reduced in weight.

An electromagnetically driven valve device according to a third aspect of the invention including a pair of electromagnets facing each other, and an armature that reciprocates by being attracted to the pair of electromagnets so as to open and close a valve element, wherein two sets each of which includes the pair of electromagnets and the armature are mounted adjacent to each other, and wherein each set of the two sets mounted adjacent to each other has a planar shape in a mounted fashion, the planar shape having a relatively long dimension and a relatively short dimension. The two sets are disposed so that a relatively long side of one of the two sets and a relatively long side of another one of the two sets are adjacent to each other, and so that a predetermined opening angle is formed between lengthwise axes of the two assemblies. Thus, the two sets having a planar shape that has a longer dimension and a shorter dimension as described above are disposed so that the longer sides of the two sets are adjacent to each other and so that the predetermined opening angle is formed between the lengthwise axes of the two sets. Therefore, an increased space is secured at an opening portion. Hence, if another member, such as an ignition plug or the like, is disposed, the member can be disposed with an increased degree of freedom.

An electromagnetically driven valve device according to a fourth aspect of the invention including a pair of electromagnets facing each other in a vertical positional relationship, and an armature that reciprocates in vertical directions by being attracted to the pair of electromagnets so as to open and close a valve element, wherein an upper surface side of an upwardly disposed electromagnet of the pair of electromagnets disposed in the vertical positional relationship or an upper surface side of an assembly incorporating the upwardly disposed electromagnet and retainer member means for retaining the upwardly disposed electromagnet is provided with a reservoir portion capable of holding a fluid that flows on an upper surface of the upwardly disposed electromagnet or an upper surface of the assembly during a non-operation state of the armature. Thus, on the upper surface side of the upwardly disposed electromagnet or the upper surface side of the assembly of the upwardly disposed electromagnet, the reservoir portion holds the fluid that flows on the upper surface of the electromagnet or the upper surface of the assembly thereof during the non-operation state of the armature, even after the electromagnetically driven valve device stops operating. Therefore, the initial supply of the fluid, for example, a lubricant or the like, at the time of startup of the electromagnetically driven valve device can be more smoothly performed.

In the fourth aspect of the invention, the reservoir portion may be a recess portion provided at the upper surface side of the upwardly disposed electromagnet or the upper surface side of the assembly incorporating the upwardly disposed electromagnet. Thus, the reservoir portion can be embodied with a simple construction.

An electromagnetically driven valve device according to the fifth aspect of the invention including a pair of electromagnets facing each other, and an armature that reciprocates by being attracted to the pair of electromagnets so as to open and close a valve element, wherein a mounting surface on which the electromagnetically driven valve device is mounted has a recess portion that contacts at least one electromagnet of the pair of electromagnets and that has a shape corresponding to a contact portion of the at least one electromagnet. The at least one electromagnet that contacts the mounting surface is disposed with a predetermined clearance from a side wall of the recess portion. Thus, the two electromagnets, the electromagnet disposed on the mounting surface side has a predetermined clearance from the side wall of the recess portion. Therefore, if a fluid is supplied for the purpose of cooling or the like, an increased amount of the fluid is supplied around the electromagnet, so that the effect of cooling or the like will increase.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

A first embodiment in which the electromagnetically driven valve device of the invention is applied to an engine valve of a vehicle-installed gasoline engine (hereinafter, simply referred to as "engine") will be described with reference to FIGS. 1 to 13C.

Figure 1:
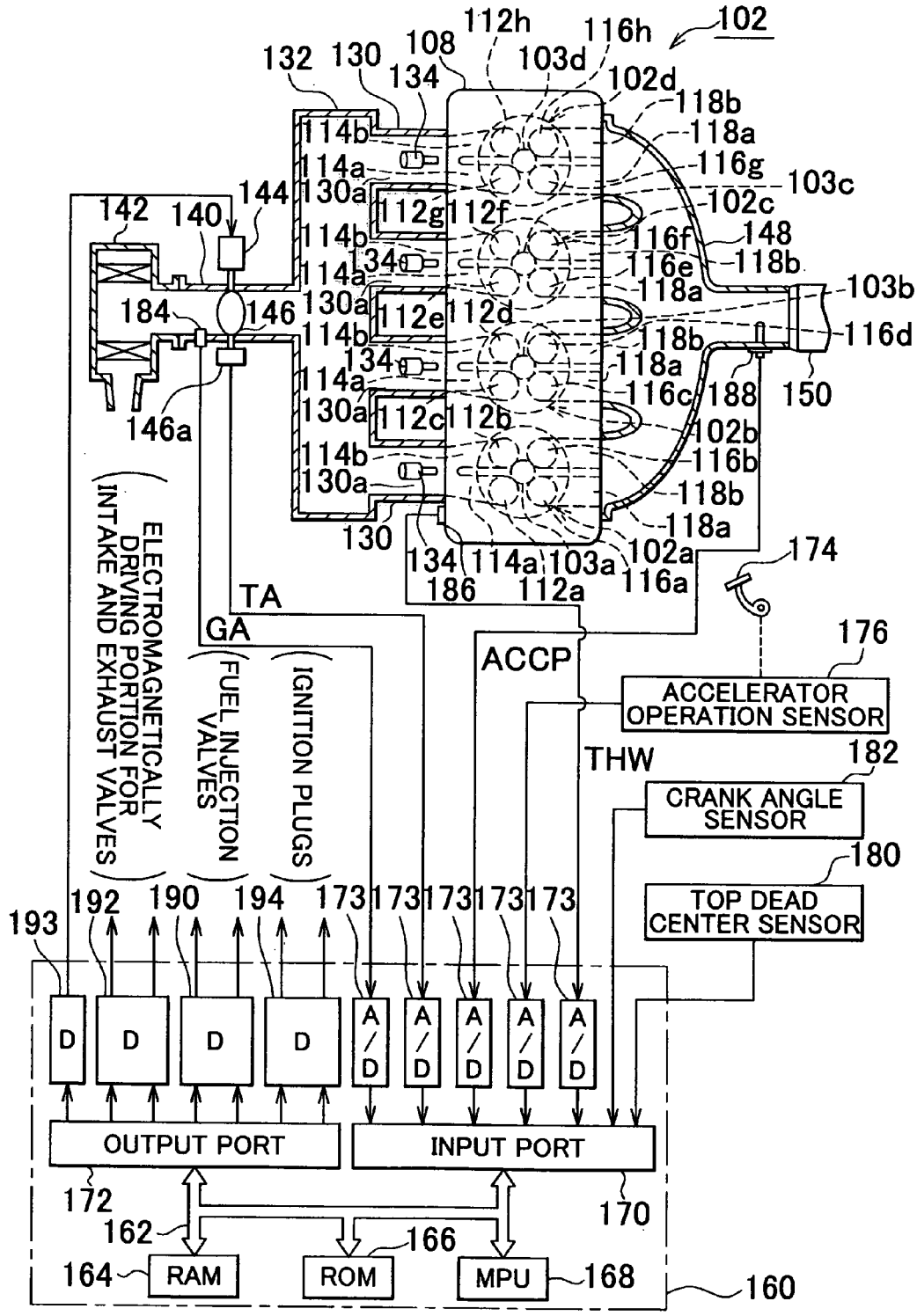
FIG. 1 is a diagram illustrating a construction of an engine to which a first embodiment of the electromagnetically driven valve device of the invention is applied.

FIG. 1 is a block diagram schematically illustrating the construction of an engine and its control system in the embodiment. Referring to FIG. 1, an engine 102 has four cylinders 102*a*, 102*b*, 102*c*, 102*d*. For each cylinder 102*a* to 102*d*, a first intake valve 112*a*, 112*c*, 112*e*, 112*g*, a second intake valve 112*b*, 112*d*, 112*f*, 112*h*, a first exhaust valve 116*a*, 116*c*, 116*e*, 116*g*, and a second exhaust valve 116*b*, 116*d*, 116*f*, 116*h* are disposed in a cylinder head 108. Each valve 112*a* to 112*h* and 116*a* to 16*h* is provided as an electromagnetically driven valve device. The first intake valve 112*a*, 112*c*, 112*e*, 112*g* opens and closes a first intake port 114*a*. The second intake valve 112*b*, 112*d*, 112*f*, 112*h* opens and closes a second intake port 114*b*. The first exhaust valve 116*a*, 116*c*, 116*e*, 116*g* opens and closes a first exhaust port 118*a*. The second exhaust valve 116*b*, 116*d*, 116*f*, 116*h* opens and closes a second exhaust port 118*b*.

In the embodiment, the engine 102 is installed in a vehicle so that the piston strokes of the cylinders 102*a* to 102*d* are in the vertical (up-down) direction. The engine valves disposed in the cylinder head 108, that is, an upper portion of the engine 102, are provided so that the opening and closing strokes thereof are in the vertical directions (more specifically, directions slightly tilted from the truly vertical direction in accordance with the configuration of the cylinder head 108).

In the engine 102 having a basic construction as described above, the first intake port 114*a* and the second intake port 114*b* of each cylinder 102*a* to 102*d* are connected in communication to a surge tank 132 via an intake passageway 130*a* that is formed in an intake manifold 130 as shown in FIG. 1. Corresponding to each cylinder, a fuel injection valve 134 is disposed in the intake passageway 130*a*. Each fuel injection valve 134 is able to inject a predetermined amount of fuel into the first intake port 114*a* and the second intake port 114*b*.

In the cylinder head 108, ignition plugs 103*a* to 103*d* are provided for the cylinders 102*a* to 102*d*, and are each disposed in a space between the first and second intake valves and the first and second exhaust valves. Each ignition plug 103*a* to 103*d* ignites a mixture of gasoline and air drawn into the combustion chamber of a corresponding one of the cylinders via the first intake port 114*a* and the second intake port 114*b*.

The surge tank 132 is connected to an air cleaner 142 via an intake duct 140. A throttle valve 146 driven by an electric motor 144 is disposed in the intake duct 140. The degree of opening of the throttle valve 146 (degree of throttle opening TA) is detected by a throttle opening sensor 146*a*. The degree of opening of the throttle valve 146 is controlled in accordance with the state of operation of the engine 102 and the operation of an accelerator pedal 174.

The first and second exhaust ports 118*a* and 118*b* of the cylinders 102*a* to 102*d* are connected to an exhaust manifold 148. The exhaust gas discharged into the exhaust manifold 148 is let out via a catalytic converter 150.

The state of operation of the engine 102 is controlled by an electronic control unit 160. The electronic control unit 160 includes a RAM (random access memory) 164, a ROM (read-only memory) 166, an MPU (microprocessor unit) 168, an input port 170, and an output port 172 that are interconnected via a bidirectional bus 162.

Various signals for operating the engine 102 are input to the electronic control unit 160. From the throttle opening sensor 146*a* for detecting the degree of throttle opening TA, an output corresponding to the degree of opening of the throttle valve 146 is input to the input port 170 via an A/D converter 173. The accelerator pedal 174 is provided with an accelerator operation sensor 176. An output of the accelerator operation sensor 176 corresponding to the amount of depression of the accelerator pedal 174 (amount of accelerator operation ACCP) is input to the input port 170 via an A/D converter 173. A top dead center sensor 180 generates an output pulse every time any one of the pistons of the cylinders 102*a* to 102*d* reaches the top dead center. Each output pulse of the sensor 180 is input to the input port 170. A crank angle sensor 182 generates an output pulse at every rotational angle of 30° of a crankshaft. Each output pulse from the sensor 182 is input to the input port 170. The MPU 168 calculates the present crank angle on the basis of output pulses from the top dead center sensor 180 and output pulses from the crank angle sensor 182, and calculates the rotation speed of the engine 102 on the basis of the frequency of output pulses from the crank angle sensor 182.

Furthermore, the intake duct 140 is provided with an intake amount sensor 184 that produces an output corresponding to the amount of intake air GA flowing in the intake duct 140. The output of the intake amount sensor 184 is input to the input port 170 via an A/D converter 173. A cylinder block of the engine 102 is provided with a water temperature sensor 186 that detects the temperature THW of the cooling water of the engine 102 and produces an output corresponding to the cooling water temperature THW. The output of the water temperature sensor 186 is input to the input port 170 via an A/D converter 173. The exhaust manifold 148 is provided with an air-fuel ratio sensor 188. An output of the air-fuel ratio sensor 188 corresponding to the air-fuel ratio is input to the input port 170 via an A/D converter 173.

Although the input port 170 receives input of various other signals, those signals are not illustrated in FIG. 1. The MPU 168 calculates and generates various signals needed for operating the engine 102 on the basis of various signals input to the electronic control unit 160, and outputs the generated signals via the output port 172.

That is, for the fuel injection valves 134 provided corresponding to the cylinders 102*a* to 102*d*, a command to perform an open-close control is output via a driving portion 190. For the electromagnetically driven valve devices provided as the intake valves 112*a* to 112*h* and the exhaust valves 116*a* to 116*h*, a command to electrify actuator coils for operating the valve devices is output via a driving portion 192. Furthermore, for the electric motor 144, a command to perform an open-close control of the throttle valve 146 is output via a driving portion 193. An activation command for the ignition plugs is output via a driving portion 194 in order to ignite the air-fuel mixture drawn into the combustion chambers in association with the coordinated operations of the electromagnetically driven valve devices and the fuel injection valves 134 and the throttle valve 146.

Although various other signals are also output from the output port 172, those signals are omitted form the illustration of FIG. 1. Next described will be a construction of the electromagnetically driven valve devices provided as the intake valves 112*a* to 112*h* and the exhaust valves 116*a* to 116*h*.

In the electromagnetically driven valve devices for each cylinder in the embodiment, the two valves provided on each of the intake side and the exhaust side, that is, the first intake valve and the second intake valve, and the first exhaust valve and the second exhaust valve, are integrated as an intake valve unit and an exhaust valve unit, respectively. Since the engine valves of the individual cylinders basically have the same construction, the valve construction of the first cylinder 102*a* will be described as an example below.

Figure 2:
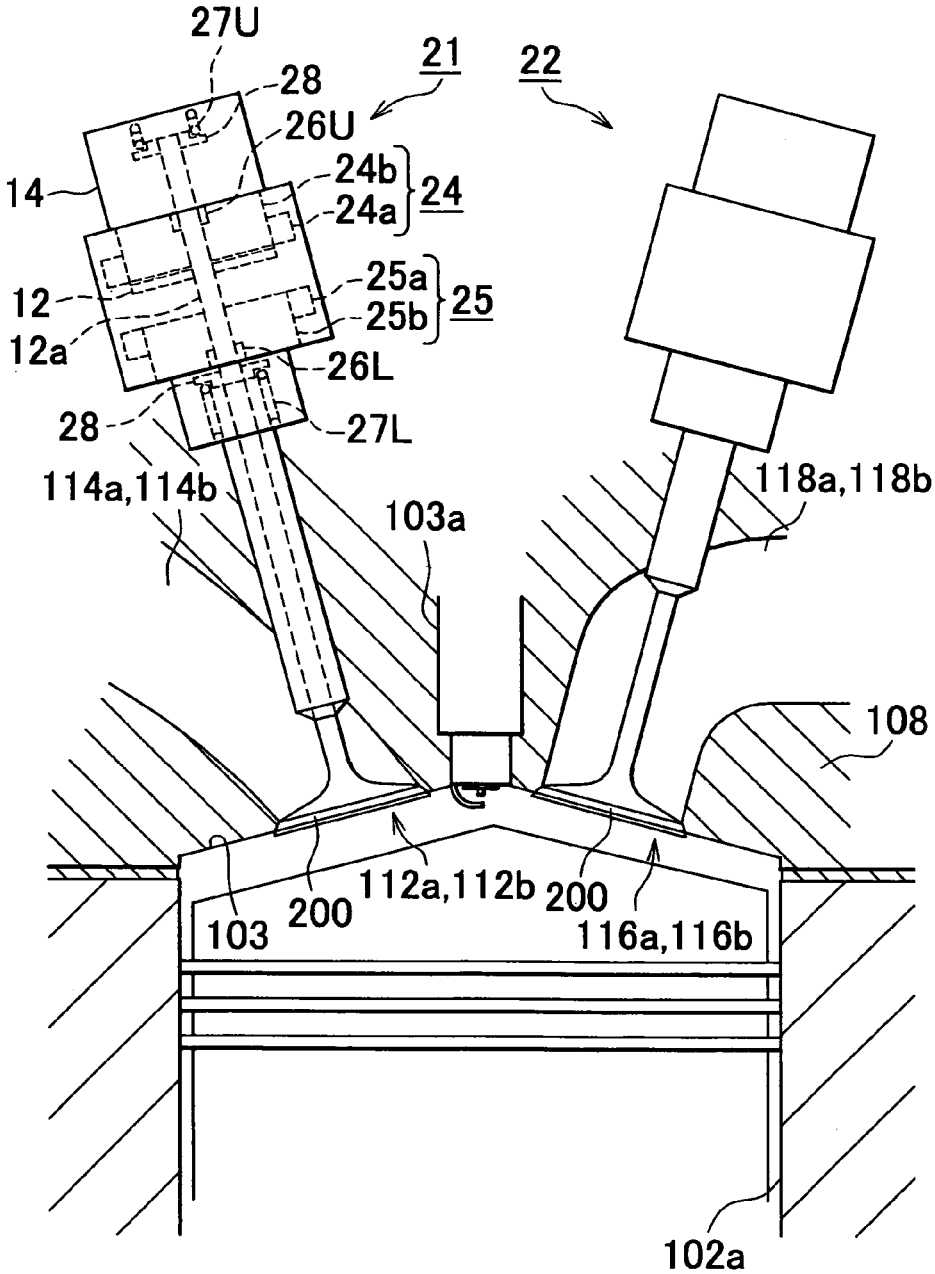
FIG. 2 is a schematic sectional view of a construction of engine valves of the engine shown in FIG. 1.

FIG. 2 is a schematic vertical sectional view of a portion of the cylinder head 108 where an electromagnetically driven valve device 21, including the first intake valve 112*a* and the second intake valve 112*b*, is mounted, and an electromagnetically driven valve device 22, including the first exhaust valve 116*a* and the second exhaust valve 116*b*, is mounted. An ignition plug 103*a* is disposed substantially at the center of a space surrounded by the four engine valves as described above. The electromagnetically driven valve devices 21 and 22 actuate the corresponding valve elements 200 for reciprocating movements, thereby opening and closing the corresponding ports.

The basic construction and the operation of the electromagnetically driven valve device 21 or 22 will be described below. Since the constructions and the operations of the electromagnetically driven valve device 21 and the electromagnetically driven valve device 22 are basically the same, the following description will be made with regard to the electromagnetically driven valve device 21.

The electromagnetically driven valve device 21 has two sets of valve arrangements each of which includes a valve element 200, an armature 12 connected to the valve element 200 for unitary motion, and two electromagnets 24, 25 that are aligned in a vertical direction (more precisely, a direction of an inclined surface in an upper portion of the cylinder head 108; however, the term "vertical direction" will be used hereinafter in that broader sense) so as to face each other with the armature 12 being disposed therebetween. It is to be noted that FIG. 2 shows only one of the two sets. The two electromagnets 24, 25 have an upper coil 24*a* and a lower coil 25*a*, respectively. When electric current is supplied through the upper and lower coils 24*a*, 25*a*, electromagnetic forces are generated between the armature 12 and an upper core 24*b* and a lower core 25*b* that form the electromagnets together with the upper coils 24*a* and the lower coils 25*a*, respectively. As for the armature 12, an armature shaft 12*a* movable together with the electromagnets 24, 25 is slidably supported by an upper bearing 26U and a lower bearing 26L that are provided in the upper core 24*b* and the lower core 25*b*, respectively. Therefore, the armature 12 is drawn up and down by electromagnetic force. Hence, upon alternate electrification of the upper coil 24*a* and the lower coils 25*a*, the armature 12 moves up and down between the electromagnets 24 and 25, moving the valve element 200 to and fro. The intake valve 112*a* or 112*b* is thus opened and closed.

The electromagnetically driven valve device 21 has, in addition to the electromagnets 24, 25, two springs as means for urging the armature 12 toward a neutral position. Thus, the armature 12 always receives force from the springs. The two springs are an upper spring 27U that urges the armature 12 downward, and a lower spring 27L that urges the armature 12 upward. The upper spring 27U and the lower spring 27L presses retainers 28 fixed at an upper end and a lower end of the armature shaft 12*a*, respectively, so that the forces of the upper spring 27U and the lower spring 27L are transferred to the armature 12. Of the two springs, the upper spring 27U is housed in an upper case 14 and is held at a predetermined position, and the lower spring 27L is sandwiched between the retainer 28 and a recess of the cylinder head 108 located below the electromagnet 25, and is thereby held at a predetermined position.

Figure 3:
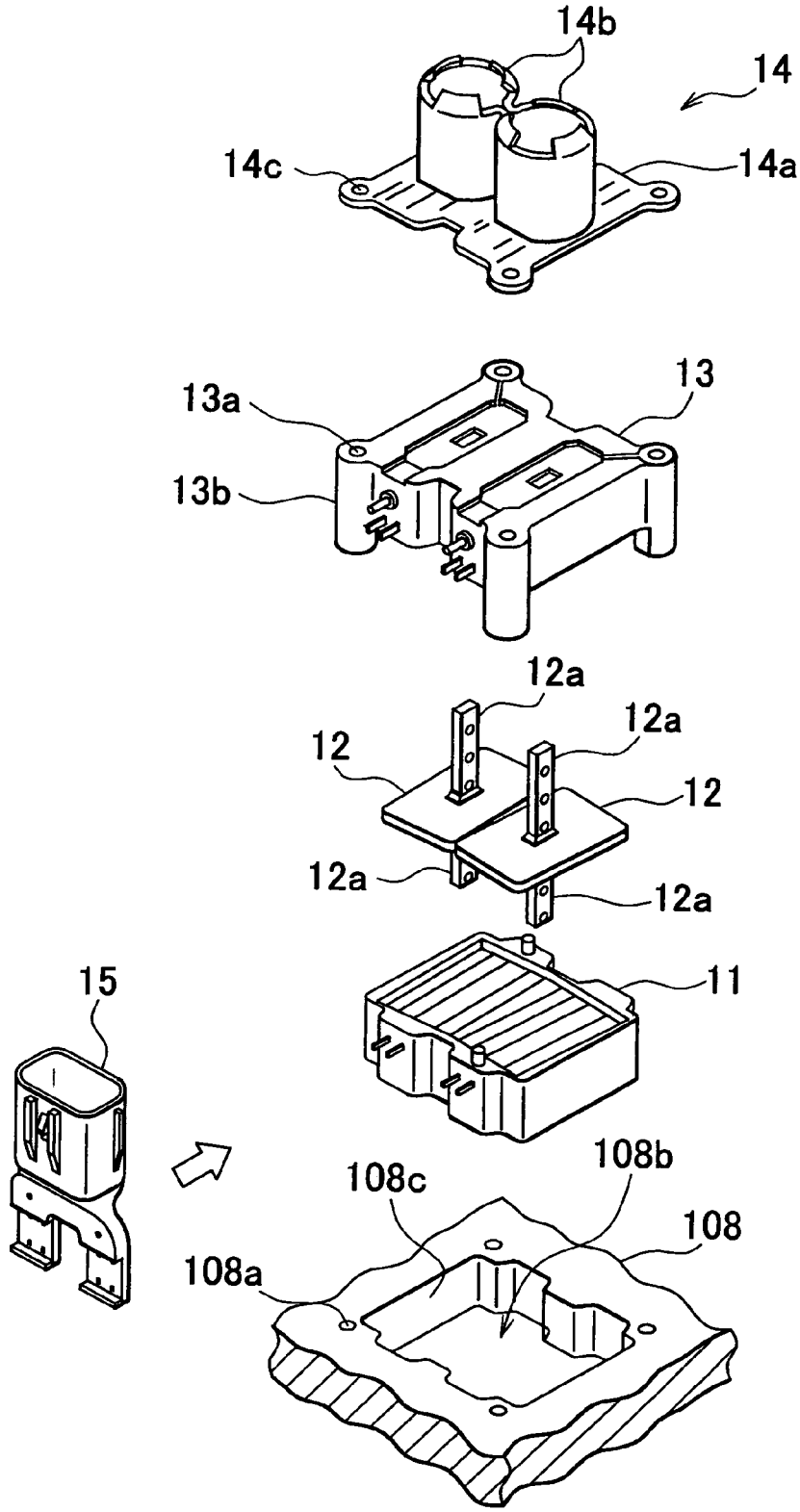
FIG. 3 is an exploded perspective view of an electromagnetically driven valve device of the engine valves.

Next, the structure of the electromagnetically driven valve device 21 and the structure for attaching the valve device 21 to the cylinder head 108 will be described in detail with reference to FIGS. 3 to 13C. FIG. 3 is an exploded perspective view of various portions of the electromagnetically driven valve device 21.

Referring to FIG. 3, the electromagnetically driven valve device 21 is formed by attaching a lower core assy 11, armatures 12, an upper core assy 13, and an upper case 14 in that order from bottom, to the cylinder head 108, that is, a mounting surface. The term "assy" herein refers to an assembly formed by assembling a plurality of component parts or consolidating a plurality of component parts through a molding process or the like. In this case, each of the lower core assy 11 and the upper core assy 13 has cores, coils and connecting terminals, and also has shaft bearings for the armature 12 (i.e., the upper bearing 26U and the lower bearing 26L in FIG. 2), and is formed by resin molding so as to have a predetermined configuration. It is to be noted herein that each of the lower core assy 11 and the upper core assy 13 is a molding having two cores, two coils and two connecting terminals as well as two armature shaft bearings corresponding to the first intake valve 112*a* and the second intake valve 112*b* actuated in the opening and closing directions by the electromagnetically driven valve device 21.

The two cores consolidated in each of the lower core assy 11 and the upper core assy 13 are adjacent to each other. In order to open and close the two valves within such a limited space in a desired fashion, it is desirable that a sufficiently great electromagnetic force act on the armature 12. In order to realize this, each core and each armature 12 have such a generally rectangular shape in a plan view that the cores and the armatures have sufficiently great inter-facing areas within the limited space. Correspondingly, each of the two coils combined has an annular shape that substantially conforms to an outer periphery of the elongated rectangular planar shape of the core assy. Each coil is embedded in a groove portion that is formed in a corresponding one of the cores in accordance with the shape of the coil. The thus-formed two pairs of electromagnets are resin-molded in such an arrangement that the two adjacent electromagnets are juxtaposed with their longer sides being adjacent to each other. As a result, each of the lower core assy 11 and the upper core assy 13 has a generally rectangular planar shape.

In this embodiment, the lower core assy 11 is fastened together with the upper core assy 13 to the cylinder head 108, that is, the mounting surface provided for the electromagnetically driven valve device 21. To that end, four corner portions of the rectangular upper core assy 13 are provided with resin-molded support column portions 13*b* each having a through-hole 13*a* for insertion of a co-fastening bolt as co-fastener means for the four corner portions. The armature 12 is disposed for vertical sliding movements within an internal space defined by the upper core assy 13 and the lower core assy 11, with the armature shaft 12*a* being supported by the bearings provided in the upper core assy 13 and the lower core assy 11. The range of upward and downward displacements of the armature 12 is determined by the interference with a lower end portion of the upper core assy 13 and an upper end portion of the lower core assy 11 within the internal space.

The upper case 14 is disposed above the upper core assy 13. As shown in FIG. 3, the upper case 14 has a base portion 14*a* that is attached to the upper core assy 13. The upper case 14 also has two generally cylindrical housing portions 14*b* that are protruded from the base portion 14*a*. The base portion 14*a* has a planar shape that is generally identical to that of the upper core assy 13. In order to attach the upper case 14 to the upper core assy 13, the base portion 14*a* is provided with through-holes 14*c* at positions corresponding to the through-holes 13*a* of the upper core assy 13. The upper core assy 13 and the upper case 14 are fastened to the cylinder head 108 by inserting co-fastening bolts (not shown) through the aligned through-holes 13*a*, 14*c* and screwing the bolts into threaded holes 108*a* formed in the cylinder head 108. The mounting surface on the cylinder head 108 is provided with a recess portion 180*b* formed corresponding to the shape of the lower core assy 11. Thus, the electromagnetically driven valve device 21 is attached to the mounting surface on the cylinder head 108, with the lower core assy 11 being partly embraced in the cylinder head 108, and being fastened together with the upper core assy 13.

Figure 4:
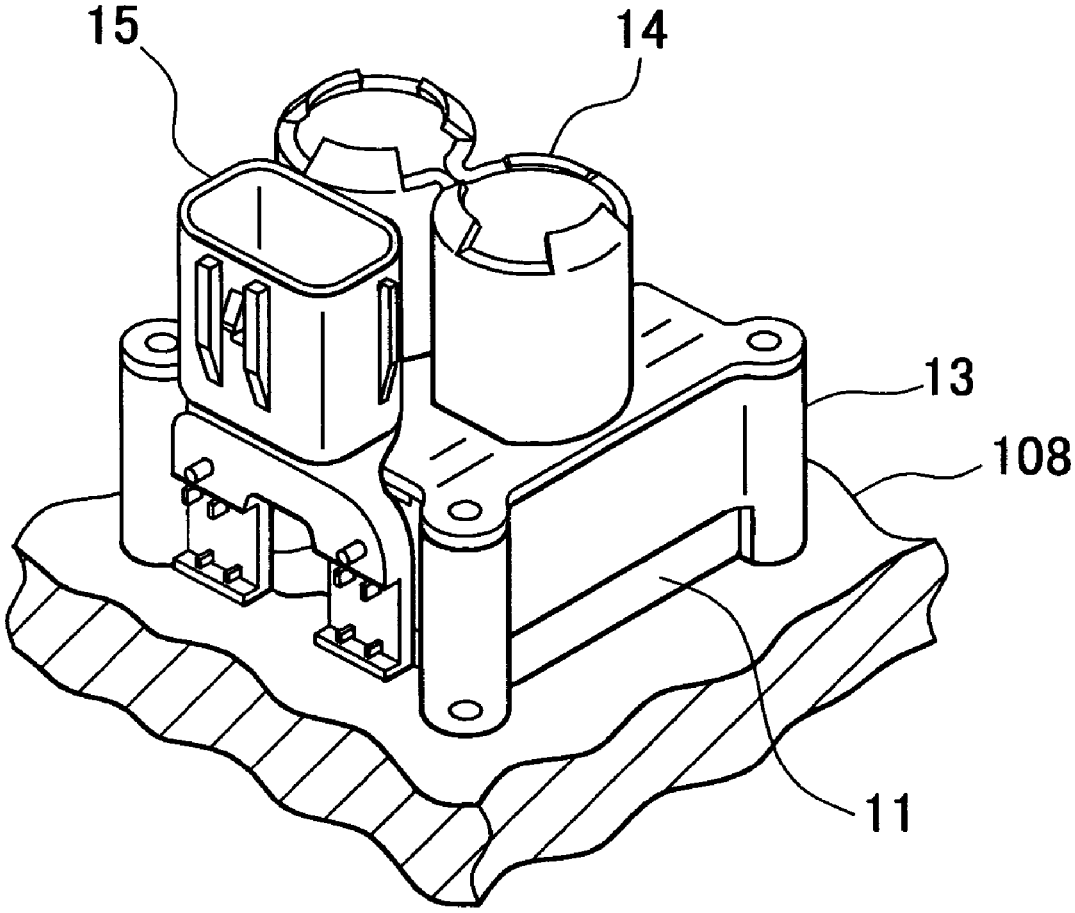
FIG. 4 is a perspective view illustrating a fashion of mounting the electromagnetically driven valve device.

After the electromagnetically driven valve device 21 is attached as described above, an adjuster 15 is attached as a connector means for electrical connection to the four coils, that is, the two coils incorporated into each of the lower core assy 11 and the upper core assy 13. FIG. 4 is a perspective view of the electromagnetically driven valve device 21 attached to the cylinder head 108.

The lower core assy 11, the upper core assy 13, the armatures 12, the upper case 14, and the adjuster 15 will be separately described below.

Figure 5A:
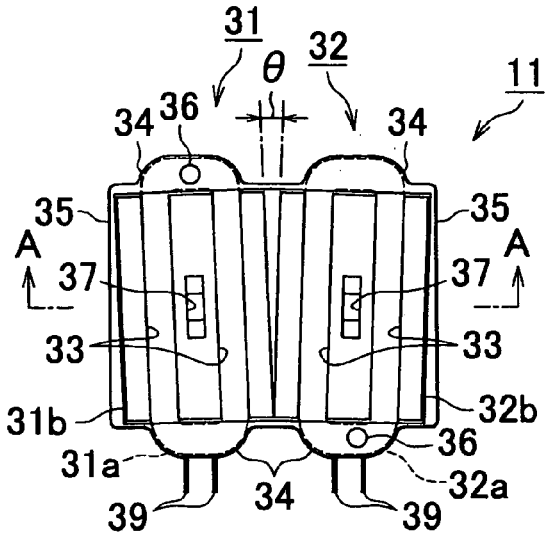
FIGS. 5A to 5C are a top plan view (FIG. 5A) of a lower core assy of the electromagnetically driven valve device, a sectional view (FIG. 5B) thereof, and a bottom plan view (FIG. 5C) thereof.
Figure 5B:
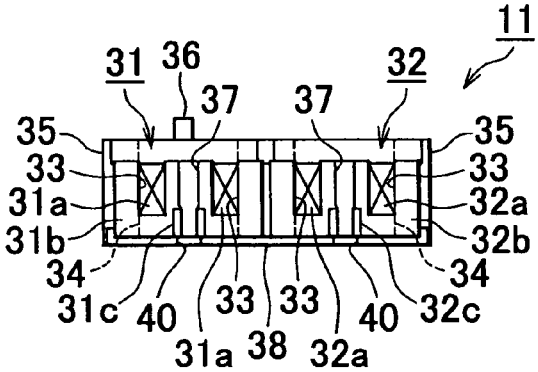
Figure 5C:
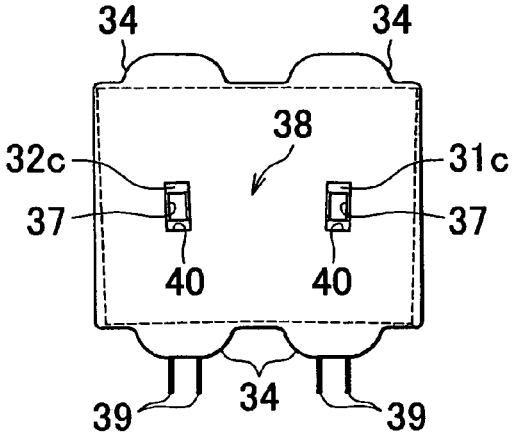

Firstly, the lower core assy 11 will be described. FIGS. 5A to 5C are a top plan view of the lower core assy 11, a sectional view taken on line A—A of the plan view, and a bottom plan view of the lower core assy 11, respectively.

As shown in FIGS. 5A and 5B, the lower core assy 11 has two electromagnets 31, 32 (both corresponding to the electromagnet 25 in FIG. 2) that are disposed corresponding to the intake valves 112*a*, 112*b* (see FIGS. 1 and 2). The electromagnet 31 is made up of a coil 31*a* and a core 31*b*, and the electromagnet 32 is made up of a coil 32*a* and a core 32*b*. The coils 31*a*, 32*a* correspond to the lower coil 25*a* shown in FIG. 2. The cores 31*b*, 32*b* correspond to the lower core 25*b* shown in FIG. 2. Each of the coils 31*b*, 32*b* has, as groove-like portions, two through-grooves 33 that extend in a lengthwise direction through the core. Each coil 31*a*, 32*a* has a rectangular annular shape with its longer sides corresponding to the through-grooves 33 and being embedded in the through-grooves 33. Thus, the lower core assy 11 has a planar configuration in which each coil 31*a*, 32*a* is protruded from the shorter sides of a corresponding one of the rectangular cores, and therefore protruded portions 34 are formed. Thus, the lower core assy 11 having a rectangular planar shape is formed by the resin-molding of the electromagnet 31 and the electromagnet 32 in such an arrangement that longer sides of the electromagnets are adjacent to each other.

The lower core assy 11, that is, a resin-molded assembly, is provided with an outer edge portion 35 rising upward to a predetermined height from an upper surface the cores 31*b*, 32*b* as shown in FIG. 5B, so as to provide a space for the vertical movements of the armature 12 (see FIG. 3). That is, in the lower core assy 11, a central portion on the upper surface side, excluding the outer edge portion 35, is formed as a recess conforming to the shape of the two armatures 12 assembled together with the lower core assy 11. Furthermore, in the lower core assy 11, vertically extending through-holes 37 for the vertical movements of the armature shafts 12*a* of the armatures 12 are formed at positions corresponding to the armature shafts 12*a*. Lower shaft bearings 31*c*, 32*c* for supporting the vertically movable armature shafts 12*a* are provided integrally with portions of the through-holes 37 located in a bottom portion of the lower core assy 11. The protruded portions 34 protruded at the shorter sides of the cores extend beyond the upper surfaces of the coils 31*a*, 32*a* so as to have upper surfaces substantially flush with the outer edge portion 35 (indicated by broken lines in FIG. 5B). Thus, the protruded portions 34, together with the outer edge portion 35, form a surface of contact with the upper core assy 13, thereby securing a mechanical strength in the vertical direction that is needed for the co-fastening with the upper core assy 13. The contact surfaces of two of the four protruded portions 34 each have a projection 36 that fits into a corresponding one of positioning holes formed in the upper core assy 13 for defining the relative positions of the lower core assy 11 and the upper core assy 13. The positioning holes will be described later. The terminal ends of the coils 31*a*, 32*a* are connected to connecting terminals 39 (FIG. 5A). The connecting terminals 39 are secured by the resin-molding so that the connecting terminals 39 are protruded out from a side face of the lower core assy 11 in the same direction. Although it is desirable that the connecting terminals 39 be protruded in the same direction, the protruding directions of the connecting terminals 39 may vary to such an extent that no practical problem arises in connecting the adjuster 15 (see FIG. 3). As for the connecting terminals 39 connected to the terminal ends of the coils 31*a*, 32*a*, it is also possible to use conductors of the coil wires exposed by stripping off the coatings or the like, or the conductors processed by metal plating, as connecting terminals 39 if the conductors of the coils 31*a*, 32*a* have sufficient mechanical strength.

As shown in FIGS. 5B and 5C, a bottom surface 38 of the lower core assy 11 is a generally flat surface, except for the portions through which the armature shafts 12*a* extend. The portions through which the armature shafts 12*a* extend are provided with broadened portions 40 of the through-holes 37. In FIG. 5C, the lower bearings 31*c*, 32*c* are exposed in the broadened portions 40.

The two electromagnets 31, 32 are juxtaposed so that longer sides thereof are adjacent to each other, and so that a predetermined opening angle θ is formed between the lengthwise axes of the electromagnets. Reasons for this arrangement will be explained later.

Figure 6A:
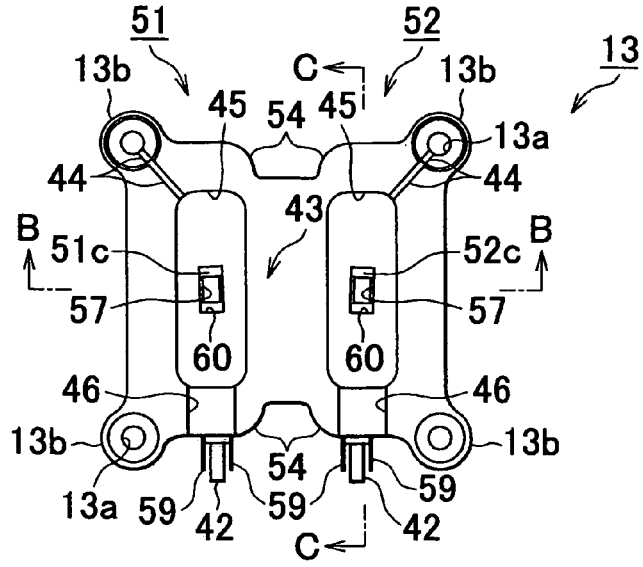
FIGS. 6A to 6C show a top plan view (FIG. 6A) of an upper core assy of the electromagnetically driven valve device, a sectional view (FIG. 6B) thereof, and a bottom plan view (FIG. 6C) thereof.
Figure 6B:
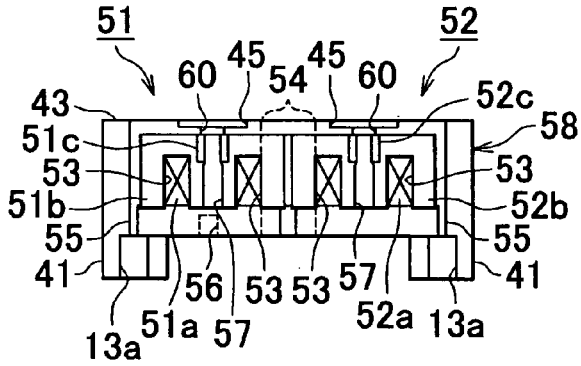
Figure 6C:
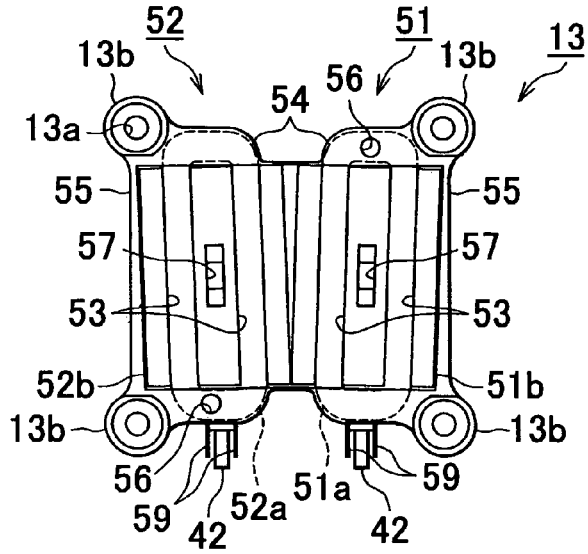

The upper core assy 13 will next be described. FIGS. 6A to 6C show a top plan view of the upper core assy 13, a sectional view taken on line B—B of the top plan view, and a bottom plan view of the upper core assy 13, respectively.

The upper core assy 13 basically has a configuration obtained by the vertical inversion of the configuration of the lower core assy 11. As shown in FIG. 6C, the upper core assy 13 is provided with two electromagnets 51, 52 (both corresponding to the electromagnet 24 in FIG. 2) that are disposed corresponding to the intake valves 112*a*, 112*b* (see FIGS. 1 and 2). The electromagnets 51, 52 make pairs with the electromagnets 31, 32 (see FIG. 3) consolidated in the lower core assy 11, respectively, so that the armatures 12 disposed between the two pairs of electromagnets are caused to reciprocate in the vertical directions. Similar to the electromagnets 31, 32, the electromagnet 51 is made up of a coil 51*a* and a core 51*b*. The electromagnet is made up of a coil 52*a* and a core 52*b*. The coils 51*a*, 52*a* correspond to the upper coil 24*a* shown in FIG. 2. The cores 51*b*, 52*b* correspond to the upper core 24*b* shown in FIG. 2. The coils 51*a*, 52*a* have a configuration generally identical to that of the coils 31*a*, 32*a*. The cores 51*b*, 52*b* have a generally identical to that of the cores 31*b*, 32*b*. Similar to the structure of the lower core assy 11, each of the cores 51*b*, 52*b* has two through-grooves 53 that extend through the core in the lengthwise direction, and the coils 51*a*, 52*a* are fitted into and embedded in the through-grooves 53. Therefore, the upper core assy 13 also has a planar configuration in which each coil 51*a*, 52*a* is protruded from the shorter sides of a corresponding one of the cores, and therefore protruded portions 54 are formed. The upper core assy 13 having a rectangular planar shape similar to that of the lower core assy 11 is formed by the resin-molding of the electromagnet 51 and the electromagnet 52 in such an arrangement that longer sides of the electromagnets are adjacent to each other. In the upper core assy 13, however, four corner portions of the rectangular planar shape are provided with support column portions 13*b* through which a co-fastening bolt is inserted to fasten the upper core assy 13 together with the lower core assy 11 to the cylinder head 108 (see FIG. 3) as described above. Each support column portion 13*b* has a through-hole 13*a* as described above with reference to FIG. 3.

The upper core assy 13 as a resin-molded assembly has, as shown in FIG. 6B, an outer edge portion 55 for providing a space for the vertical movements of the armatures 12 (see FIG. 3) as in the lower core assy 11. That is, in the upper core assy 13, too, a central portion on the lower surface side, excluding the outer edge portion 55, is formed as a recess conforming to the shape of the two armatures 12 assembled together with the lower core assy 11. Furthermore, in the upper core assy 13, vertically extending through-holes 57 for the vertical movements of the armature shafts 12*a* of the armatures 12 are formed at positions corresponding to the armature shafts 12*a*, as in the structure of the lower core assy 11. Upper shaft bearings 51*c*, 52*c* for supporting the vertically movable armature shafts 12*a* are provided integrally with portions of the through-holes 57 located in an upper portion 58 of the upper core assy 13. The protruded portions 54 protruded at the shorter sides of the cores extend beyond the lower surfaces of the coils 51*a*, 52*a* to a height equal to the height of the outer edge portion 55. The term "height" herein refers to a downward dimension from the upper surface of the upper core assy 13 being a reference surface. Thus, the protruded portions 54, together with the outer edge portion 55, form surfaces of contact with the lower core assy 11, thereby securing a mechanical strength in the vertical direction that is needed for the co-fastening with the lower core assy 11. The contact surfaces of two of the four protruded portions 54 each have a positioning hole 56 that fits to a corresponding one of the projections 36 formed in the lower core assy 11 for defining the relative positions of the upper core assy 13 and the lower core assy 11. The terminal ends of the coils 51*a*, 52*a* are connected to connecting terminals 59 (FIG. 6C). The connecting terminals 59 are fixed by the resin-molding so that the connecting terminals 59 are protruded out from a side face of the upper core assy 13 in the same direction as the connecting terminals 39 of the lower core assy 11. Although it is desirable that the connecting terminals 59 be protruded in the same direction, the protruding directions of the connecting terminals 59 may vary to such an extent that no practical problem arises in connecting the adjuster 15 (see FIG. 3). As for the connecting terminals 59 connected to the terminal ends of the coils 51*a*, 52*a*, it is also possible to use conductors of the coil wires exposed by stripping off the coatings or the like, or the conductors processed by metal plating, as connecting terminals 59 if the conductors of the coils 51*a*, 52*a* have sufficient mechanical strength. In this respect, the upper core assy 13 is substantially the same as the lower core assy 11. The upper core assy 13 further has guides 42 that extend in the same direction as the connecting terminals 59, so as to allow proper attachment of the adjuster 15.

Figure 7:
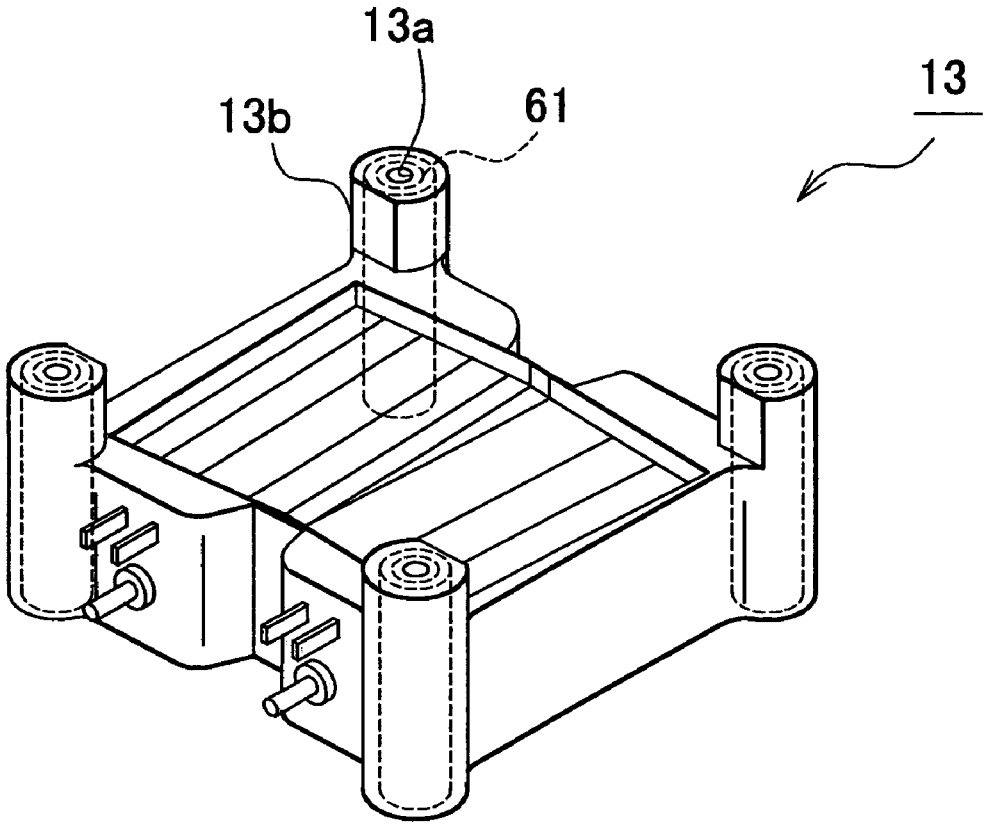
FIG. 7 is a perspective view of a bottom surface of the upper core assy seen from diagonally below.

Referring to FIG. 7 showing a perspective view of the upper core assy 13 seen from diagonally below, each support column portion 13*b* is provided with a cylindrical iron-made metallic spacer 61 embedded in the support column portion 13*b* so as to surround the through-hole 13*a*. The upper core assy 13 is provided with the four support column portions 13*b* as shown in FIG. 7. The through-hole 13*a* formed in each support column portion 13*b* is surrounded by the metallic spacer 61 that is consolidated with the support column portion 13*b* by resin molding. Therefore, the resin-molded support column portions 13*b* have a sufficient mechanical strength for the fastening via co-fastening bolts. Hence, the mounting height with respect to the mounting surface can be more precisely adjusted, so that the mounting precision can be improved.

The electromagnetically driven valve device 21 is supplied with lubricant so that the armatures 12 smoothly move up and down. The lubricant cools the electromagnets 51, 52 in addition to lubricating the upper bearings 51*c*, 52*c* supporting the armature shafts 12*a*. In this embodiment, the lubricant is the same lubricant used for the engine 102 (see FIG. 1), and is therefore conveyed to the electromagnetically driven valve device 21 in association with the operation of the engine 102. In order to achieve this, the supply of the lubricant to the electromagnetically driven valve device 21 is accomplished via oil passageways (not shown) extending to the threaded holes 108*a* (see FIG. 3) of the cylinder head 108 and oil grooves (not shown) that are formed on the co-fastening bolts (not shown) and connected in communication to the oil passageways, instead of using a tube or piping. The lubricant supplied via the oil passageways and the oil grooves is introduced into oil supplying groove 44 that are formed at an upper surface side of the support column portions 13*b* of the upper core assy 13 as shown in FIG. 6A and are connected in communication to the oil grooves of the co-fastening bolts. As for the oil supplying grooves 44, one groove is provided corresponding to each one of the electromagnets 51, 52. In this case, two oil supplying grooves 44 in total are formed at an upper surface side of the two support column portions 13*b* opposite from the side of the upper core assy 13 where the connecting terminals 59 are provided. The lubricant is also conducted to oil reservoir portions 45 that are formed on an upper surface 43 of the upper core assy 13 and are connected in communication to the oil supplying grooves 44. Each oil reservoir portion 45 is a generally rectangular recess space formed in a central portion of an area of the upper surface 43 of the upper core assy 13 which is adjacent to a corresponding one of the electromagnets 51, 52, and is able to hold the lubricant supplied from the corresponding oil supplying groove 44. The lubricant held in the oil reservoir portions 45 is supplied to the upper bearings 51*c*, 52*c* via broadened portions 60 of through-holes 57. The lubricant also serves as a cooling medium for the electromagnets 51, 52. In this case, the oil reservoir portions 45 are each provided with a large area corresponding to the electromagnets 51, 52, in order to improve the efficiency of cooling the electromagnets 51, 52. The oil reservoir portions 45 serve as an initial lubricant source for the upper bearings 51*c*, 52*c* at the time of startup of the engine 102, thus contributing to smooth initial operation of the electromagnetically driven valve device 21. The advantage of smooth initial operation of the electromagnetically driven valve device 21 achieved by the initial supply of the lubricant becomes particularly remarkable if the engine 102 is started up after a long period of the stopped state of the engine 102.

Figure 8:
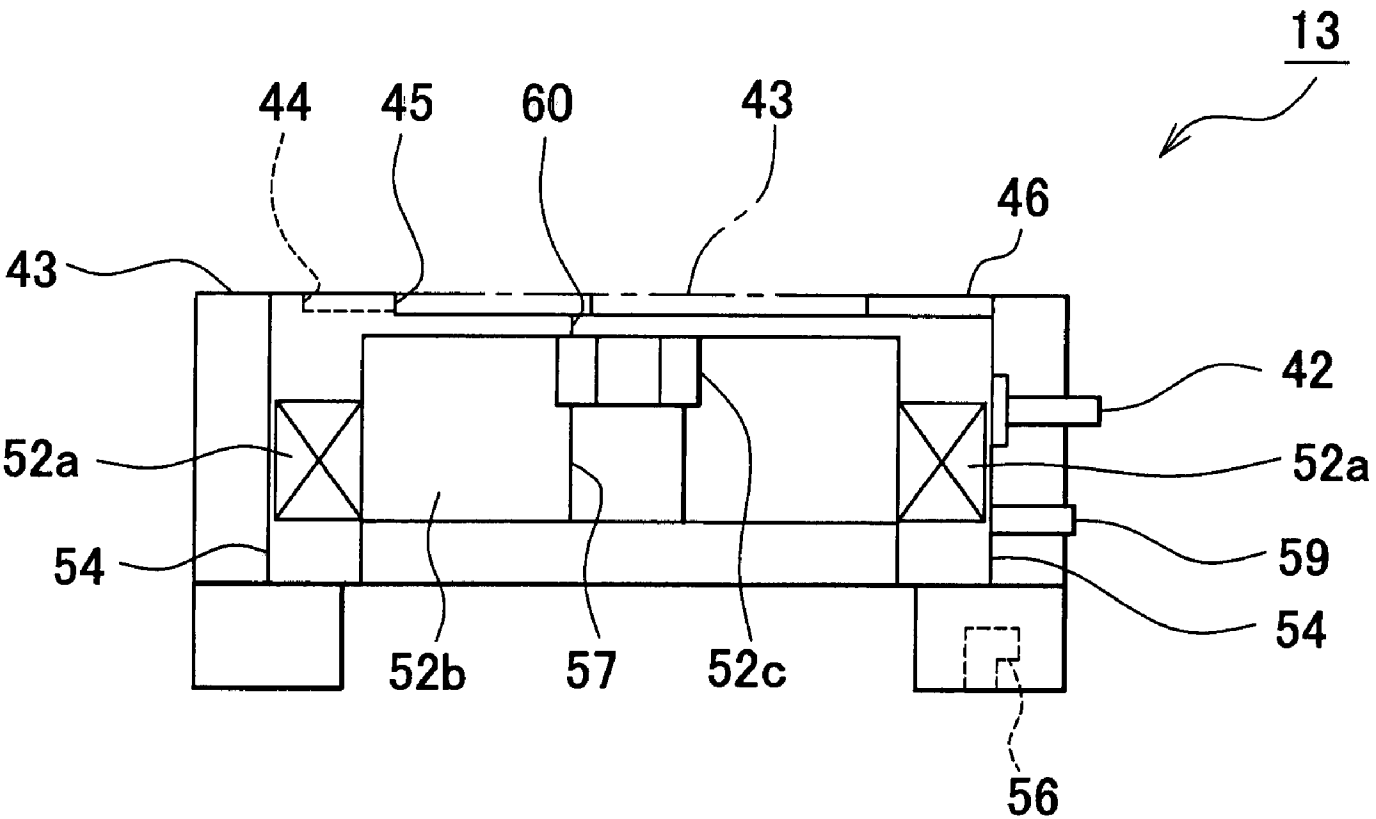
FIG. 8 is a sectional of the upper core assy taken on a plane in a lengthwise direction.

In order to avoid the reserve of excessive amounts of lubricant in the oil reservoir portions 45, the upper surface 43 of the upper core assy 13 is provided with drain grooves 46 that connect the oil reservoir portions 45 to the outside in communication and thereby promote discharge of the lubricant. Referring to FIG. 8 showing a sectional view taken on line C—C in FIG. 6A, each drain groove 46 forms a recess space that is shallower than the oil reservoir portions 45. In this case, the drain grooves 46 are provided at the same side as the protruded connecting terminals 59. The protruded connecting terminals 59 are provided at the side of the electromagnetically driven valve device 21 remote from the exhaust-side electromagnetically driven valve device 22, in order to facilitate the attachment of the adjuster 15. Therefore, as shown in FIG. 2, the upper core assy 13 is tilted so that the drain groove side is lower, when the electromagnetically driven valve device 21 is mounted on the cylinder head 108. Thus, a predetermined amount of the lubricant supplied via the oil supplying grooves 44 is held in the oil reservoir portions 45, and excessive amount of the lubricant supplied, if any, is easily discharged out via the drain grooves 46. The drain grooves 46 avoid the reserve of excessive amount of the lubricant in the oil reservoir portions 45 and therefore avoids impediment of the motion of the retainers 28 (see FIG. 2) attached to the armature shafts 12*a*, and promotes circulation of the lubricant held in the oil reservoir portions 45 and therefore improves the efficiency in cooling the electromagnets and the bearings.

Figure 9:
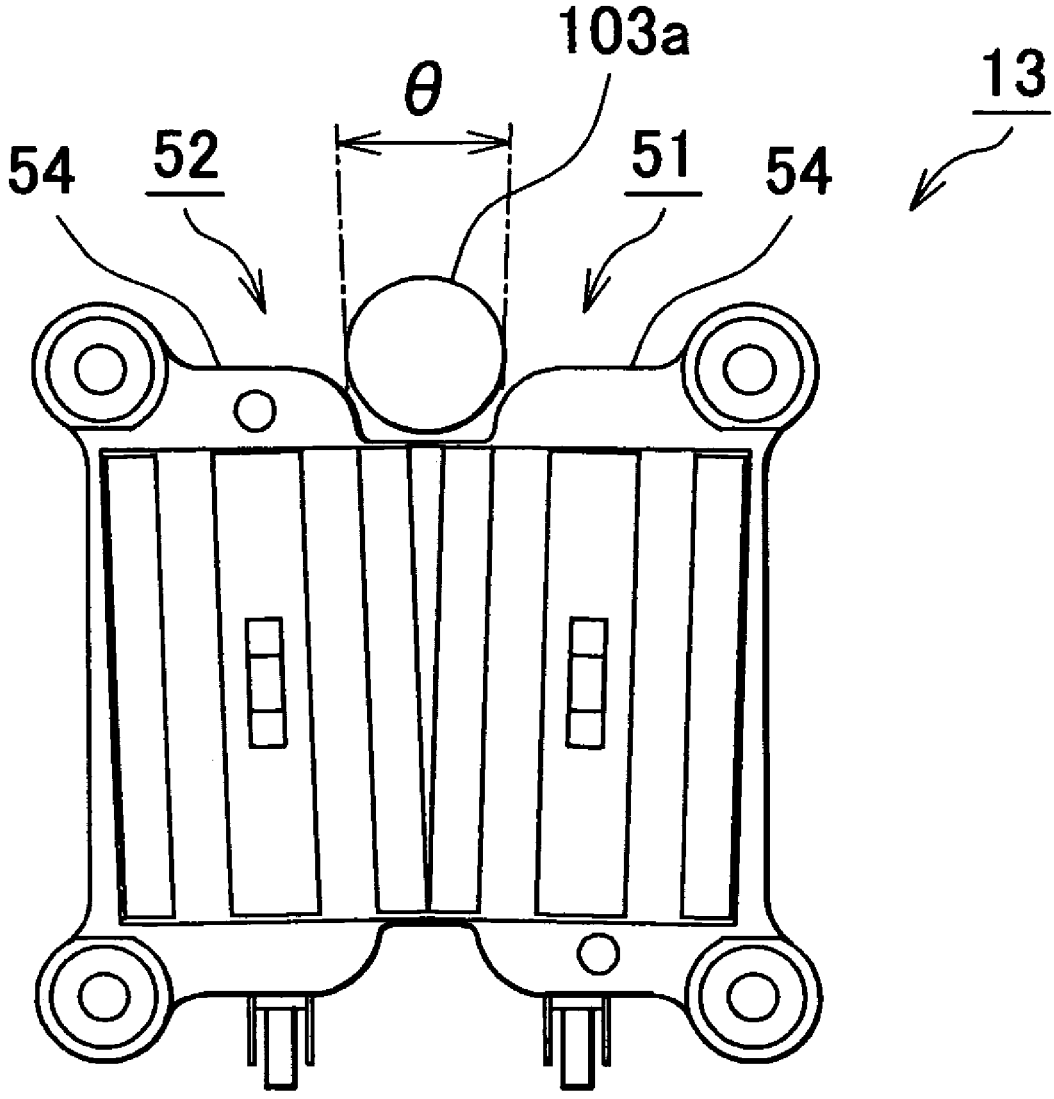
FIG. 9 is a plan view of the upper core assy illustrating an opening angle formed therein.

Referring to FIG. 9 showing a bottom plan view of the upper core assy 13, the two electromagnets 51, 52 are arranged so that longer sides of the electromagnets 51, 52 are adjacent to each other and a predetermined opening angle θ is formed between lengthwise axes of the electromagnets 51, 52, as in the electromagnets 31, 32. This arrangement is adopted for the following reasons. On the cylinder head 108, a space surrounded by the first and second intake valves and the first and second exhaust valves of the first cylinder 102*a* is provided with the ignition plug 103*a*. However, in a case where the two magnets are arranged so that the adjacent longer sides thereof are in contact with each other and where the electromagnetically driven valve device 21 and the electromagnetically driven valve device 22 are disposed adjacent to each other, the space surrounded by the four engine valves becomes small so that it may be difficult to dispose the ignition plug 103*a*. In the embodiment, therefore, the two electromagnets 31, 32 and the two electromagnets 51, 52 are disposed so that the longer sides thereof are adjacent to each other and a predetermined opening angle θ is formed between the lengthwise axes of the two electromagnets. As a result, a large space for disposing the ignition plug 103*a* is formed in a portion surrounded by the protruded portions 34 and 54 provided at the opened side.

Figure 10A:
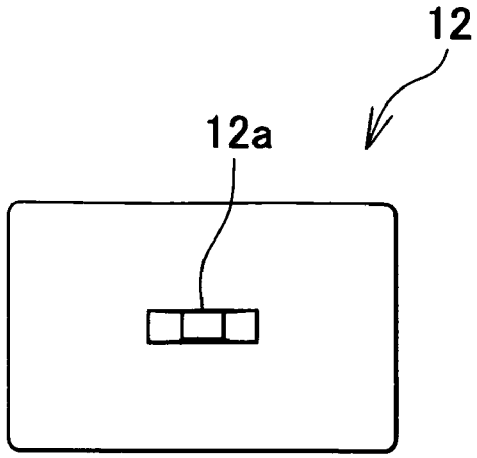
FIGS. 10A and 10B are a plan view (FIG. 10A) and a front elevation (FIG. 10B) of an armature of the electromagnetically driven valve device.
Figure 10B:
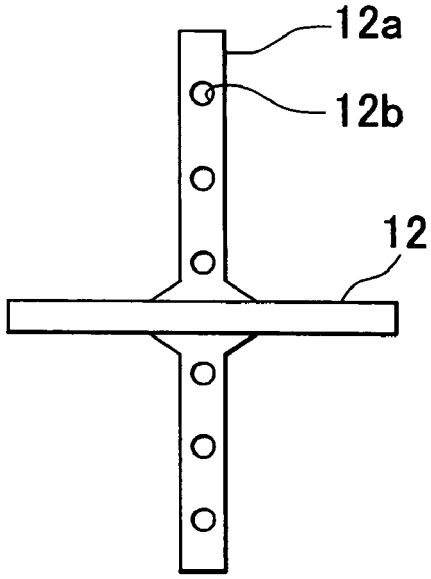

The armatures 12 will next be described. FIGS. 10A and 10B are a top plan view and a front elevation of an armature 12 with its armature shaft 12*a*. As described above, the armature 12 has a planar shape identical to that of a core having a rectangular outer periphery (FIG. 10A). The external dimensions of the armature 12 are set so that the armature 12 can be housed within a space surrounded by the upper core assy 13 and the lower core assy 11, and can be smoothly moved up and down. A central portion of the armature 12 is provided with the armature shaft 12*a* that is unitary formed therewith and extends perpendicularly to a plane of the armature 12. A section of the armature shaft 12*a* taken on a plane parallel to the plane of the armature 12 has a rectangular shape. The rectangular sectional shape of the armature shaft 12*a* is adopted in order to prevent rotation of the armature 12 during vertical movements of the armature 12. As shown in FIG. 10B, the armature shaft 12*a* has a plurality of through-holes 12*b* that extend through the shaft 12*a* in a direction perpendicular to the plane of the sheet of the drawings. The through-holes 12*b* are formed so as to reduce the weight of the armature shaft 12*a* and therefore improve the followability of the vertical movements of the armature shaft 12*a* based on electromagnetic forces created between the electromagnets 31, 32 and the electromagnets 51, 52.

Figure 11A:
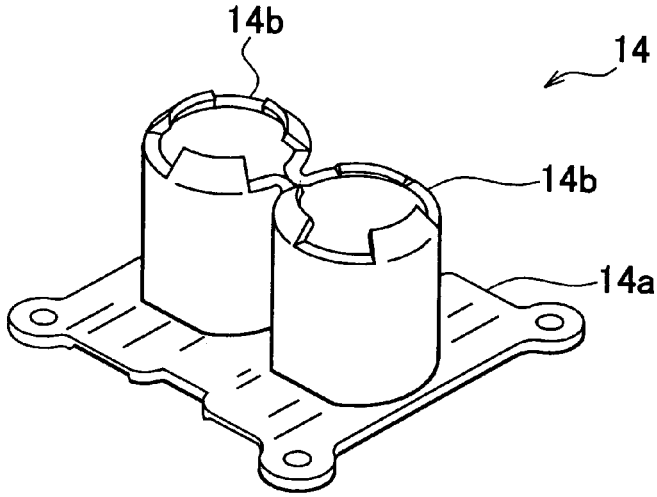
FIGS. 11A to 11C are a perspective view (FIG. 11A), a plan view (FIG. 11B) and a front elevation (FIG. 11C) of an upper case of the electromagnetically driven valve device.
Figure 11B:
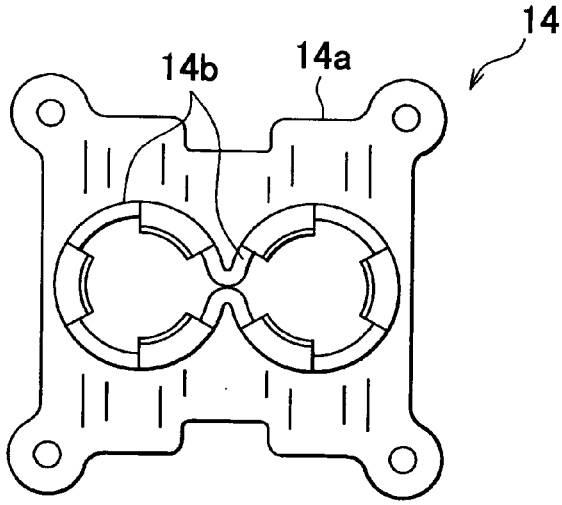
Figure 11C:
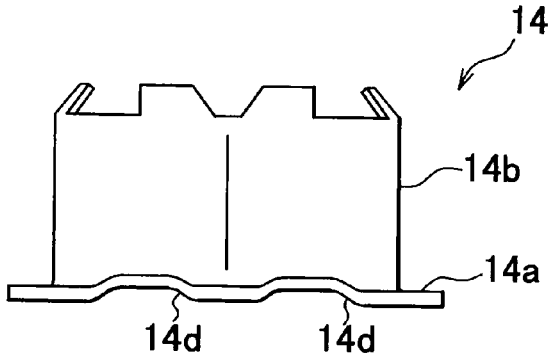

The upper case 14 will next be described. FIGS. 11A to 11C are a perspective view, a top plan view and a front elevation of the upper case 14. As described above, the upper case 14 has a base portion 14*a* and two generally cylindrical housing portions 14*b* rising from the base portion 14*a* corresponding to the two armatures provided for vertical movements in the electromagnetically driven valve device 21. Each housing portion 14*b* houses an upper spring 27U, a retainer 28 (see FIG. 2) and the like for urging the armature shaft 12*a* of a corresponding one of the armatures. In the embodiment, the upper case 14 is formed by pressing a plate that contains a magnetic material. Therefore, formation of the upper case 14 becomes easier, and the upper case 14 can be provided with a magnetic shield property. The two generally cylindrical housing portions 14*b* are provided in a connected formation so as to improve rigidity as shown in FIGS. 11A and 11B. The upper case 14 is basically formed so that a lower surface of the base portion 14*a* tightly contacts the upper surface 43 (see FIG. 6) of the upper core assy 13. The base portion 14*a* of the upper case 14, as shown in FIG. 11C, is provided with upwardly receded drain passageways 14*d* that extend in the direction of the lengthwise axes of the electromagnets 51, 52 in one-to-one correspondence to the electromagnets 51, 52. Therefore, it becomes possible to smoothly accomplish the supply and discharge of the lubricant with respect to a heat-producing portion near the electromagnets and a movable portion around the armature 12 associated with vertical movements of the armature 12.

Figure 12A:
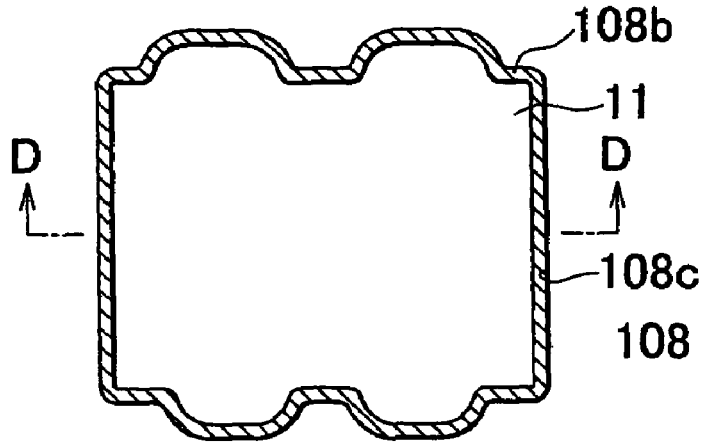
FIGS. 12A and 12B are a plan view (FIG. 12A) and a sectional view (FIG. 12B) schematically illustrating a fashion of mounting the lower core assy.
Figure 12B:
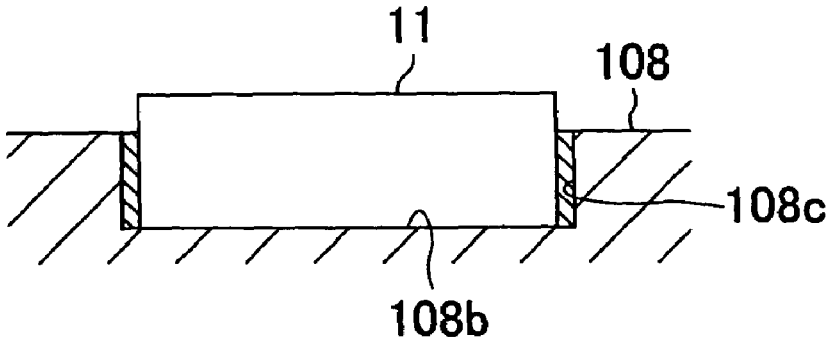

The attachment of the lower core assy 11 to the cylinder head 108 will next be described. FIGS. 12A and 12B are a schematic plan view illustrating a fashion of attaching the lower core assy 11 to the cylinder head 108, and a sectional view taken on line D—D in the plan view. As shown in FIGS. 12A and 12B, the mounting surface of the cylinder head 108 for the electromagnetically driven valve device 21 is provided with a recess portion 108*b* conforming to the external shape of the lower core assy 11 and having a predetermined depth. A predetermined clearance is provided between a side wall 103*c* of the recess portion 108*b* and the lower core assy 11. The clearance space is supplied with lubricant, thereby promoting the cooling of the lower core assy 11.

Next described will be the attachment of the adjuster 15, electrical connector means for the upper core assy 13 and the lower core assy 11 mounted on the cylinder head 108.

Figure 13A:
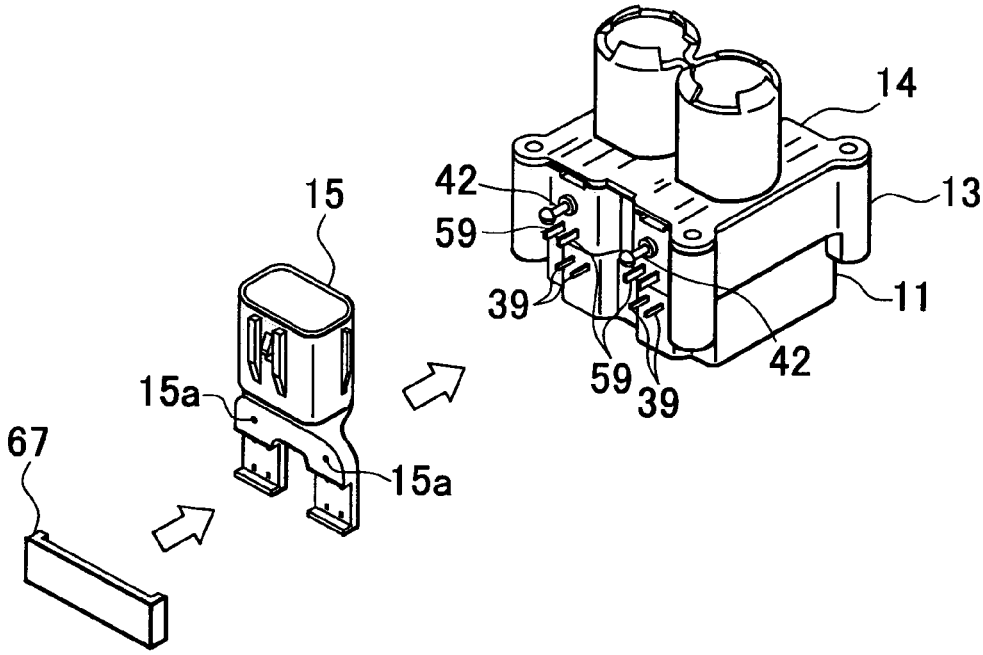
FIG. 13A is an exploded perspective view illustrating a fashion of attaching an adjuster for electrically connecting the lower core assy and the upper core assy.

FIG. 13A is an exploded schematic perspective view illustrating a fashion of attaching the adjuster 15 to an assembly formed by assembling the upper core assy 13, the lower core assy 11, etc. As shown in FIG. 13A, the upper core assy 13 and the lower core assy 11 are assembled so that the connecting terminals 59 and the connecting terminals 39 connected to the coils incorporated in the upper core assy 13 and the lower core assy 11 are protruded out in the same direction. Furthermore, the guides 42 for guiding the attachment of the adjuster 15 are provided extending in the protruding direction of the connecting terminals. The adjuster 15 is attached with the guides 42 being inserted into guide holes 15*a* formed in the adjuster 15. This fashion of attaching the adjuster 15 with assistance of the guides 42 facilitates the electrical connection to the connecting terminals 59 and the connecting terminals 39 by one action, and substantially prevents inadvertent breakage of a connecting terminal at the time of the electrical connecting operation. After the adjuster 15 is connected, an adjuster cover 67 is attached so as to shield the connecting terminals 59 and the connecting terminals 39.

Figure 13B:
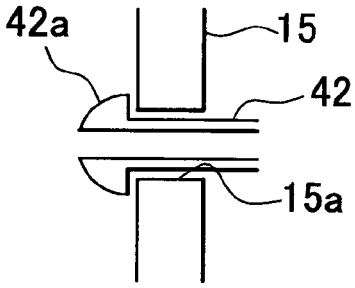
FIG. 13B is an enlarged view of an attachment portion illustrating a structure of a guide having a snap-fit structure.
Figure 13C:
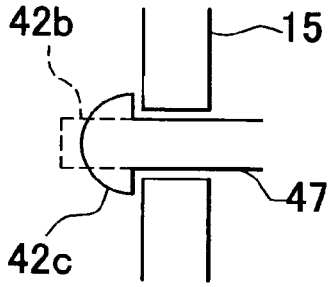
FIG. 13C is an enlarged view of an attachment portion illustrating a structure where a guide is deformed.

Referring to FIG. 13B showing a structure of an attaching portion, a head portion 42*a* of each guide 42 has a snap-fit structure in this embodiment. The snap-fit structure head portion 42*a* of each guide 42 is engaged with a corresponding one of the guide holes 15*a* of the guide forming the attaching portions together with the guides 42, at the time of attachment to the adjuster 15. That is, the guides 42 function as guide means for guiding the attachment of the adjuster 15, and have a fall-apart preventing mechanism for preventing the guides 42 from falling apart. The measure for causing the guides to function as a mechanism for preventing the adjuster 15 from falling apart is not limited to the snap-fit structure of the head portion 42*a* of each guide 42. For example, it is also possible to connect cylindrical guides 47 to the adjuster 15 and then deform the head portion 42*b* of each guide via heat, ultrasonic wave or the like so as to form a stopper portion 42*c* of each guide (FIG. 13C).

The electromagnetically driven valve device of the embodiment achieves the following advantages.

In an electromagnetically driven valve device 21 having a pair of electromagnets for attracting an armature 12, an upper core assy 13 as an assembly containing one of the two electromagnets is fastened to the cylinder head 108 together with a lower core assy 11 as an assembly of the other one of the two electromagnets. In this manner, the two electromagnets and the armature 12 are assembled. Therefore, it is possible to retain the electromagnets and the armature 12 at predetermined positions without attaching a housing for retaining the electromagnets and the armature. Hence, the electromagnetically driven valve device 21 can be simply constructed as an engine valve of the engine 102. Furthermore, if a light-weight material is used for the retention means combined with an electromagnet, the device can be reduced in weight.

The consolidation of the electromagnets is accomplished by resin molding. Therefore, energy of vibration produced due to impacts of the armature 12 on the lower core assy 11 and the upper core assy 13 is absorbed by the resin that has greater elasticity than metals. Hence, the operation noise of the electromagnetically driven valve device 21 is reduced.

The upper case 14 housing the upper spring 27U for urging the armature 12 in a downward direction relative to the assembly is formed by a press process. Therefore, the upper case 14 can be easily obtained without performing a cutting or grinding process or the like.

The upper case 14 has a magnetic shield effect since the upper case 14 is formed of a plate that contains a magnetic material. Therefore, if a sensor or the like utilizing magnetism, as for example, is disposed within the upper case 14, undesired magnetic interference with an external device or the like can be avoided without a need to provide a separate member as a magnetic shield.

A surface of the upper case 14 that faces the upper core assy 13 is provided with the upwardly receded drain passageways 14*d* that extend in the direction of the lengthwise axes of the electromagnets 51, 52 in one-to-one correspondence to the electromagnets 51, 52. Therefore, lubricant can be smoothly supplied to and around the upper core assy 13.

Since the two generally cylindrical housing portions 14*b* of the upper case 14 are connected to each other, rigidity can be improved.

In each of the upper core assy 13 and the lower core assy 11, the two electromagnets 51, 52 and the two electromagnets 31, 32 have a shape with a longer dimension and a shorter dimension, and are arranged so that longer sides thereof are adjacent to each other and a predetermined opening angle θ is formed between the lengthwise axes of the two electromagnets. As a result, when the upper core assy 13 and the lower core assy 11 are mounted, a large space for disposing the ignition plug 103*a* is formed at the opened side of the upper core assy 13 and the lower core assy 11.

The upper core assy 13, fastened together with the lower core assy 11, is provided with the through-holes 13*a* for insertion of co-fastening bolts for the co-fastening operation, and is supplied with lubricant via the through-holes 13*a* and the oil grooves formed on the co-fastening bolts. Therefore, the lubricant for lubricating and cooling the upper core assy 13 is supplied from a source via a simple construction without a need to employ a tube or piping.

The upper core assy 13 is provided with the upper bearings 51*c*, 52*c* consolidated with the upper core assy 13 for supporting the vertically movable armature shaft 12*a* of the armature 12. The surface of the upper core assy 13 remote from the cylinder head 108 is provided with the oil reservoir portions 45 formed in portions that include portions near the upper bearings and that are adjacent to the electromagnets 51, 52. The oil reservoir portions 45 also functions as passageways of the lubricant. Therefore, the lubrication and cooling of the upper bearings 51*c*, 52*c* and the cooling of the electromagnets 51, 52 can be effectively accomplished. Furthermore, since the bearings for supporting the vertically movable armature shaft 12*a* of the armature 12 are integrally provided with the upper core assy 13, it becomes unnecessary to separately provide a bearing for supporting the armature 12. Thus, the size of the electromagnetically driven valve device 21 can be reduced.

The upper core assy 13 is disposed with the oil reservoir portions 45 being located upward. Therefore, a predetermined amount of lubricant is held in the oil reservoir portions 45 even after the electromagnetically driven valve device 21 is stopped (i.e., the engine 102 is stopped). Therefore, when operation of the electromagnetically driven valve device 21 is started again, the initial supply of the lubricant is smoothly accomplished.

The iron-made cylindrical metallic spacers are embedded in the support column portions 13*b* so as to surround the through-holes 13*a*. Therefore, sufficient strength of the upper core assy 13 for the co-fastening via co-fastening bolts can be secured while the upper core assy 13 is unitarily formed using a resin. Furthermore, the mounting height with respect to the mounting surface can be more precisely adjusted.

The mounting surface on the cylinder head 108 for the electromagnetically driven valve device 21 is provided with the recess portion 108*b* that has a predetermined depth and that conforms to the external shape of the lower core assy 11 with a predetermined clearance from the lower core assy 11. Therefore, an increased amount of lubricant is supplied around the lower core assy 11 so as to more effectively cool the lower core assy 11.

The upper core assy 13 and the lower core assy 11 are formed so that the connecting terminals 59 and 39 of the coils integrated with the upper core assy 13 and the lower core assy 11, respectively, are exposed on surfaces. Therefore, it is possible to make electrical connection to the coils from outside after assembling and co-fastening the upper core assy 13 and the lower core assy 11 together with the armatures 12 and the upper case 14 to the cylinder head 108. Thus, this construction is favorable for the electric wiring layout operation.

The coil connecting terminals 59 and 39 are disposed in a predetermined positional relationship on the surface of the upper core assy 13 and the surface of the lower core assy 11 that face in the same direction. Therefore, the efficiency in the electric wiring operation can be improved. The adjuster 15 for connecting the connecting terminals 59, 39 by one action in accordance with the aforementioned positional relationship is attached to the connecting terminals 59, 39. Therefore, the connection of the connecting terminals 59, 39 can be accomplished by one action.

Furthermore, at least one of the surfaces of the upper core assy 13 and the lower core assy 11 facing in the same direction has a guide 42 for guiding the attachment of the adjuster 15 to the exposed connecting terminals 59, 39 of the coils, so that the attaching operation can be more properly performed and the danger of breaking the connecting terminals 59, 39 is reduced.

The head portions 42*a* of the guides 42 have a snap-fit structure for engagement with the guide holes 15*a* at the time of attachment of the adjuster 15. Therefore, the guides 42 prevent the adjuster 15 from falling apart, in addition to performing the function as guide means for guiding the attachment of the adjuster 15.

The foregoing embodiment may be modified as follows. Although the mechanisms for preventing the adjuster 15 from falling apart described above in conjunction with the embodiment are the snap-fit structure of the guides 42 and the guide holes 15*a*, and the deformation of the head portions 42*a* of the guides 42 after the insertion into the guide holes 15*a*, other constructions may also be adopted to prevent the adjuster 15 from falling apart. That is, any fall-apart preventing mechanism may be adopted as long as the mechanism prevents the adjuster 15 from falling apart after being attached.

Although in the embodiment, the guides 42 for guiding the attachment of the adjuster 15 to the connecting terminals 59, 39 of the coils integrated with the electromagnets 51, 52 and the electromagnets 31, 32 are provided on at least one of the surfaces that are provided with the connecting terminals 59 and 39 and that face in the same direction, this construction is not restrictive. For example, it is possible to adopt a construction without a guide 42 if the omission of a guide arrangement does not give rise to a danger of inadvertent breakage of the connecting terminals 59, 39 at the time of attachment of the adjuster 15.

Although in the foregoing embodiment, the connecting terminals 59, 39 of the coils are disposed in a predetermined positional relationship on the surfaces that face in the same direction, this construction is not restrictive. If the connection of wires to the connecting terminals 59, 39 is easy although the connecting terminals 59, 39 of the coils are disposed in a predetermined positional relationship on the surfaces that face in the same direction, the connecting terminals 59, 39 do not need to be disposed on surfaces that face in the same direction, or do not need to have a predetermined positional relationship.

Although in the foregoing embodiment, the connecting terminals 59 and the connecting terminals 39 are protruded from and fixed at a surface of the upper core assy 13 and a surface of the lower core assy 11, this construction is not restrictive. For example, it is possible to adopt a construction in which the connecting terminals 59, 39 are withdrawn from the surfaces and are embedded and fixed in surface portions so that the connection sites on the connecting terminals are connectable from outside. That is, any construction is appropriate as long as the connecting terminals 59, 39 are embedded and are exposed on a surface of the upper core assy 13 and a surface of the lower core assy 11 so that electrical connection to the coils can be easily made from outside.

Although in the foregoing embodiment, the mounting surface on the cylinder head 108 for the electromagnetically driven valve device 21 is provided with the recess portion 108*b* that has a predetermined depth and that conforms to the external shape of the lower core assy 11 with a predetermined clearance from the lower core assy 11, this construction is not restrictive. If the lower core assy 11 does not need to be cooled, or can be sufficiently cooled without the recess portion 108*b*, it is possible to adopt a construction in which the recess portion 108*b* is not formed. If an increased amount of lubricant is desired around the lower core assy 11, it is possible to adopt, for example, a construction in which predetermined-shape grooves are formed in the bottom surface 38 of the lower core assy 11 and/or a surface of contact with the bottom surface 38.

Although in the foregoing embodiment, iron-made cylindrical metallic spacers are embedded in the support column portions 13*b* so as to surround the through-holes 13*a*, this construction is not restrictive. It is possible to adopt a construction in which spacers of a different shape and a different material other than iron which have a sufficient rigidity for desired adjustment of the mounting height of the electromagnetically driven valve device 21 at the time of the co-fastening via co-fastening bolts are disposed near the through-holes 13*a*. Furthermore, if the resin molding has a sufficient rigidity for desired adjustment of the mounting height at the time of the co-fastening via co-fastening bolts, it is not altogether necessary to embed spacers in the support column portions 13*b*.

Although in the foregoing embodiment, the upper core assy 13 is disposed so that the oil reservoir portions 45 are located upward, this construction is not restrictive. It is not altogether necessary to dispose the upper core assy 13 so that the oil reservoir portions 45 are located upward, in an electromagnetically driven valve device 21 designed so that a sufficient amount of lubricant is supplied immediately upon startup of the engine, or in an electromagnetically driven valve device 21 designed so that the need for lubricant is not great immediately after startup of the engine.

In the foregoing embodiment, the upper core assy 13 incorporates the upper bearings 51*c*, 52*c* for supporting the armatures 12 for reciprocating movements, and has the oil reservoir portions 45 that are formed in portions of the surface of the upper core assy 13 remote from the cylinder head 108 which include portions near the upper bearings 51*c*, 52*c* and which are adjacent to the electromagnets 51, 52. However, the invention is not restricted by this construction. That is, the construction related to the oil reservoir portions 45 may be omitted if the lubrication and cooling of the upper bearings 51*c*, 52*c* and the cooling of the electromagnets 51, 52 can be effectively performed without the provision of oil reservoir portions 45. If it is easy to separately attach bearings for supporting the armatures, or if there is no need to reduce the size of the electromagnetically driven valve device 21, it is not altogether necessary that the bearings for supporting the armatures for reciprocating movements be consolidated with the upper core assy 13.

In the foregoing embodiment, the upper core assy 13, co-fastened with the lower core assy 11, is provided with the support column portions 13*b* each having a through-hole 13*a* for insertion of a co-fastening bolt for the co-fastening operation, and is supplied with lubricant via the through-holes 13*a* and the oil passageways formed on the co-fastening bolts. However, the invention is not restricted by this construction. That is, the construction in which the supply of lubricant is accomplished via the through-holes 13*a* is not altogether necessary if lubricant can be easily supplied from a source via a tube or piping, or if a lubricant for lubrication or cooling is not needed. Furthermore, although in the foregoing embodiment, there are two routes of supply of lubricant via the oil passageways through threaded holes 108*a* of the cylinder head 108 and the oil grooves formed on the co-fastening bolts screwed into the threaded holes 108*a*, this construction is not restrictive. That is, it is possible to provide only one route or more than two routes of supply of lubricant.

In the foregoing embodiment, the two electromagnets 51, 52 of the upper core assy 13 and the two electromagnets 31, 32 of the lower core assy 11 each have a longer dimension and a shorter dimension, and are juxtaposed so that longer sides of the two electromagnets are adjacent to each other and so that a predetermined opening angle θ is formed between the lengthwise axes of the two electromagnets. However, this construction does not restrict the invention. For example, if the need for a space for disposing the ignition plug 103*a* or the like is not great, it is not altogether necessary to arrange the electromagnets with an opening angle θ formed therebetween.

Although in the foregoing embodiment, the upper case 14 is provided with the two generally cylindrical housing portions 14*b* connected to each other, this construction is not restrictive. The construction in which the housing portions 14*b* are interconnected is not altogether necessary if rigidity is not a great concern. Although in the electromagnetically driven valve device of the embodiment, two pairs of electromagnets for causing the armatures to reciprocate, this construction is not restrictive. For example, in a construction including three or more pairs of electromagnets, the upper case may be provided with three or more connected housing portions.

Although in the foregoing embodiment, the upper case 14 is provided with the upwardly receded drain passageways 14*d* that extend in the direction of the lengthwise axes of the electromagnets 51, 52 in one-to-one correspondence to the electromagnets 51, 52, this construction is not restrictive. The upper case 14 may be provided without such a drain passage 14*d* if the armature-adjacent movable portion that operates in association with the reciprocating movements of the armature does not desperately need lubricant or if sufficient supply of lubricant is possible without such a drain passage 14*d*.

Although in the foregoing embodiment, the upper case 14 is formed of a plate containing a magnetic material, this construction is not restrictive. The upper case 14 does not need to be formed of a magnetic material-containing plate, if it is possible to dispose a magnetic shield member around the upper case 14, or if magnetic interference between the outside and the inside of the upper case 14 does not cause a problem.

Although in the foregoing embodiment, the upper case 14 disposed on an upper surface of the upper core assy 13 and housing the upper springs 27U for urging the armatures 12 downward is formed by a pressing process, this construction is not restrictive. For example, the upper case may be formed by casting or the like provided that the formation of the upper case through a process including cutting, grinding or the like does not give rise to a problem.

Although in the foregoing embodiment, consolidation of the electromagnets into the upper or lower core assy is accomplished by resin-molding, this construction is not restrictive. If the energy of vibration produced due to impacts of the armatures 12 on the lower core assy 11 or the upper core assy 13 does not become a problem, the electromagnet retaining means may be formed by a molding process using a material having a higher rigidity than resin. The formation by molding is also illustrative. Other forming processes may also be employed provided that the electromagnets and the electromagnet retaining means can be formed so as to have a predetermined shape.

Although the electromagnetically driven valve device in the foregoing embodiment incorporates two valves, this construction is not restrictive. That is, the invention is applicable not only to an electromagnetically driven valve device incorporating two valves, but also to an electromagnetically driven valve device incorporating one valve and an electromagnetically driven valve device incorporating three or more valves.

Although in the foregoing embodiment, the mounting surface for the electromagnetically driven valve device 21 is provided on the cylinder head 108 of the engine 102, the mounting surface may also be provided at a location other than the cylinder head 108. For example, the mounting surface may be provided on a cam carrier that houses cams, and the like.

Although in the foregoing embodiment, the electromagnetically driven valve device of the invention is applied to a four-cylinder automotive gasoline engine that has four engine valves for each cylinder, this construction is not restrictive. That is, the electromagnetically driven valve device of the invention is applicable not only to a vehicle-installed engine, a four-cylinder engine, or an engine having four engine valves for each cylinder, but also to various other engines having valve mechanisms.

What is claimed is:

1. An electromagnetically driven valve device comprising:

a pair of electromagnets facing each other; and an armature that reciprocates by being attracted to the pair of electromagnets so as to open and close a valve element, wherein at least a first electromagnet of the pair of electromagnets is integrated with a retainer member that retains the first electromagnet so as to form an assembly, wherein the pair of electromagnets and the armature are mounted by co-fastening the assembly together with a second electromagnet of the pair of electromagnets or another assembly to a mounting surface provided for the electromagnetically driven valve device, and further comprising a co-fastening member that co-fastens the assembly and the second electromagnet or the another assembly to the mounting surface, wherein the co-fastening member is disposed in a through-hole formed in the assembly so as to fix the assembly to the mounting surface, and wherein the through-hole allows a fluid to be supplied to the assembly.

2. The electromagnetically driven valve device according to claim 1, wherein the retainer member is molded together with the electromagnet so as to have a predetermined shape and unitarily retain the electromagnet.

3. The electromagnetically driven valve device according to claim 1, further comprising:

an urging member that is provided on a face in the assembly which is remote from the mounting surface and that urges the armature in a direction of the mounting surface; and a casing that is provided in the assembly and that houses the urging member, wherein the casing is formed by pressing.

4. The electromagnetically driven valve device according to claim 3, wherein the casing is formed using a material containing a magnetic substance.

5. The electromagnetically driven valve device according to claim 3, wherein the casing has such a shape as to form a gap that allows passage of a fluid between the casing and the assembly that is fastened together with the second electromagnet or the another assembly.

6. The electromagnetically driven valve device according to claim 3, wherein at least two armature-electromagnet sets each of which includes the pair of electromagnets and the armature movable in association with the pair of electromagnets are disposed adjacent to each other, and wherein at least two casings provided corresponding to the at least two armature-electromagnet sets are formed in such a fashion that the at least two casings are connected to each other.

7. The electromagnetically driven valve device according to claim 1, wherein each electromagnet has a planar shape having a relatively long dimension and a relatively short dimension, and wherein two pairs of electromagnets are provided, and the assemblies are formed with respect to each pair of electromagnets, and both assemblies are provided so as to attract the armature in the same direction, and wherein the two electromagnets integrated are disposed so that a relatively long side of one of the two electromagnets and a relatively long side of another one of the two electromagnets are adjacent to each other, and so that a predetermined opening angle is formed between lengthwise axes of the two electromagnets.

8. The electromagnetically driven valve device according to claim 1, further comprising a spacer disposed near the through-hole in which the co-fastening member is disposed, wherein the spacer is provided for adjusting a mounting height of the assembly fastened together with the second electromagnet or the another assembly, with respect to the mounting surface.

9. The electromagnetically driven valve device according to claim 1, further comprising a recess portion that forms the mounting surface and that substantially conforms to a shape of the second electromagnet or the another assembly fastened together with the assembly, wherein the recess portion provides a predetermined clearance between a side wall of the recess portion and the second electromagnet or the another assembly fastened together with the assembly.

10. The electromagnetically driven valve device according to claim 1, wherein each electromagnet of the pair of electromagnets is integrated with the retainer member that retains the electromagnet so as to form an assembly, and a first assembly of the two assemblies is fastened together with a second assembly of the two assemblies to the mounting surface for the electromagnetically driven valve device so as to mount the pair of electromagnets and the armature, and wherein a coil of each electromagnet is embedded in a corresponding assembly of the two assemblies so that a connecting terminal of the coil is exposed on a surface of the corresponding assembly.

11. The electromagnetically driven valve device according to claim 10, wherein the connecting terminals of the coils are disposed in a predetermined positional relationship in a surface of the first assembly and a surface of the second assembly which face in one direction.

12. The electromagnetically driven valve device according to claim 11, further comprising a guide member that guides attachment of a connector member for electrical connection of the connecting terminals of the coils, wherein the guide member is disposed on at least one of the surface of the first assembly and the surface of the second assembly which face in one direction.

13. The electromagnetically driven valve device according to claim 12, further comprising a fall-apart preventing mechanism that substantially prevents the guide member from falling apart, wherein the guide member is provided with the fall-apart preventing mechanism provided in an attachment portion that is engaged when the connector member is attached to the surface of the first assembly and the surface of the second assembly which face in one direction.

14. The electromagnetically driven valve device according to claim 1, further comprising:

a supporting portion that is provided in the assembly co-fastened with the second electromagnet or the another assembly and that supports the armature for the reciprocating movements; and a fluid passageway in which the fluid passes, wherein the fluid passageway includes a first recess portion provided in a surface of the assembly which is opposite from a surface that is attached to the mounting surface, the first recess portion being provided in a portion of the surface that includes a portion near the supporting portion and that is adjacent to the electromagnet incorporated in the assembly.

15. The electromagnetically driven valve device according to claim 14, wherein the assembly is disposed so that a surface of the assembly which is opposite from the surface attached to the mounting surface is located upward.

16. An electromagnetically driven valve device comprising:

a pair of electromagnets facing each other; and an armature that reciprocates by being attracted to the pair of electromagnets so as to open and close a valve element, wherein at least a first electromagnet of the pair of electromagnets is integrated with retention means for retaining the first electromagnet so as to form an assembly, wherein the pair of electromagnets and the armature are mounted by co-fastening the assembly together with a second electromagnet of the pair of electromagnets or another assembly to a mounting surface provided for the electromagnetically driven valve device further comprising a co-fastening member that co-fastens the assembly and the second electromagnet or the another assembly to the mounting surface, wherein the co-fastening member is disposed in a through-hole formed in the assembly so as to fix the assembly to the mounting surface, and wherein the through-hole allows a fluid to be supplied to the assembly.

17. An electromagnetically driven valve device comprising:

a pair of electromagnets facing each other; and an armature that reciprocates by being attracted to the pair of electromagnets so as to open and close a valve element, wherein two sets each of which includes the pair of electromagnets and the armature are mounted adjacent to each other, and wherein each set of the two sets mounted adjacent to each other has a planar shape in a mounted fashion, the planar shape having a relatively long dimension and a relatively short dimension, and the two sets are disposed so that a relatively long side of one of the two sets and a relatively long side of another one of the two sets are adjacent to each other, and so that a predetermined opening angle is formed between lengthwise axes of the two assemblies.

18. An electromagnetically driven valve device comprising:

a pair of electromagnets facing each other in a vertical positional relationship; and an armature that reciprocates in vertical directions by being attracted to the pair of electromagnets so as to open and close a valve element, wherein an upper surface side of an upwardly disposed electromagnet of the pair of electromagnets disposed in the vertical positional relationship or an upper surface side of an assembly incorporating the upwardly disposed electromagnet and retainer member means for retaining the upwardly disposed electromagnet is provided with a reservoir portion capable of holding a fluid that flows on an upper surface of the upwardly disposed electromagnet or an upper surface of the assembly during a non-operation state of the armature.

19. The electromagnetically driven valve device according to claim 18, wherein the reservoir portion is a recess portion provided at the upper surface side of the upwardly disposed electromagnet or the upper surface side of the assembly incorporating the upwardly disposed electromagnet.

20. An electromagnetically driven valve device comprising:

a pair of electromagnets facing each other; and an armature that reciprocates by being attracted to the pair of electromagnets so as to open and close a valve element, wherein a mounting surface on which the electromagnetically driven valve device is mounted has a recess portion that contacts a core assembly accommodating one electromagnet of the pair of electromagnets and that has a shape corresponding to a contact portion of the core assembly, and the core assembly is disposed with a predetermined clearance from a side wall of the recess portion.

* * * * *